US006698041B2

(12) United States Patent
VanSteenburg et al.

(10) Patent No.: US 6,698,041 B2
(45) Date of Patent: Mar. 2, 2004

(54) PATIENT TRANSFER APPARATUS

(75) Inventors: Kip P. VanSteenburg, Sudbury, MA (US); George T. Wong, Chelmsford, MA (US)

(73) Assignee: The OR Group, Inc., Batesville, IN (US)

( * ) Notice: Subject to any disclaimer, the term of this patent is extended or adjusted under 35 U.S.C. 154(b) by 116 days.

(21) Appl. No.: 09/789,042

(22) Filed: Feb. 20, 2001

(65) Prior Publication Data

US 2001/0047543 A1 Dec. 6, 2001

Related U.S. Application Data

(60) Provisional application No. 60/222,244, filed on Aug. 1, 2000, and provisional application No. 60/193,891, filed on Mar. 31, 2000.

(51) Int. Cl.[7] ..... A61G 7/08

(52) U.S. Cl. ..... 5/81.1 R; 5/81.1 C; 5/88.1; 5/89.1

(58) Field of Search ..... 5/81 C, 88.1, 89.1, 5/81.1 HS, 81.1 R

(56) References Cited

U.S. PATENT DOCUMENTS

| | | | | | |
|---|---|---|---|---|---|
| 3,418,670 | A | | 12/1968 | Morgan | |
| 3,493,979 | A | | 2/1970 | Koll et al. | |
| 3,654,644 | A | | 4/1972 | Stevens | |
| 3,760,435 | A | * | 9/1973 | Jardine | 5/81.1 C |
| 3,781,929 | A | | 1/1974 | Stevens | |
| 3,854,152 | A | * | 12/1974 | Chez | 5/81.1 C |
| 3,871,036 | A | * | 3/1975 | Attenburrow | 414/527 |
| 3,967,328 | A | | 7/1976 | Cox | |
| 4,073,016 | A | * | 2/1978 | Koll | 5/81.1 C |
| 4,077,073 | A | | 3/1978 | Koll et al. | |
| 4,087,873 | A | * | 5/1978 | Ohkawa | 5/81.1 C |
| 4,125,907 | A | | 11/1978 | Junginger et al. | |
| 4,156,946 | A | | 6/1979 | Attenburrow | |
| 4,371,997 | A | | 2/1983 | Mattson | |
| 4,680,818 | A | * | 7/1987 | Ooka et al. | 5/81.1 C |
| 4,726,082 | A | * | 2/1988 | DiMatteo et al. | 5/81.1 C |
| 4,761,841 | A | * | 8/1988 | Larsen | 5/81.1 C |
| 4,794,655 | A | * | 1/1989 | Ooka et al. | 5/81.1 C |
| 4,805,626 | A | * | 2/1989 | DiMassimo et al. | 269/20 |
| 4,821,352 | A | | 4/1989 | DiMatteo et al. | |
| 4,837,872 | A | | 6/1989 | DiMatteo et al. | |
| 4,924,538 | A | * | 5/1990 | Kume | 5/81.1 C |
| 4,941,220 | A | | 7/1990 | DiMatteo et al. | |
| 4,967,427 | A | | 11/1990 | Cherepy, Sr. | |
| 4,970,738 | A | | 11/1990 | Cole | |
| 5,048,133 | A | * | 9/1991 | Iura et al. | 5/81.1 C |
| 5,067,189 | A | | 11/1991 | Weedling et al. | |
| 5,127,113 | A | | 7/1992 | DiMatteo et al. | |
| 5,319,813 | A | | 6/1994 | DiMatteo et al. | |
| 5,390,379 | A | | 2/1995 | Palmer, Jr. et al. | |

(List continued on next page.)

FOREIGN PATENT DOCUMENTS

EP 0843991 A1 5/1998

OTHER PUBLICATIONS

Hill–Rohm Product Catalogue—ON3 Lateral Transfer, 4 pages, downloaded from www.hill–rom.com/usa/products/prodlist2.asp, © 2000.*

*Primary Examiner*—J. J. Swann
*Assistant Examiner*—Kathleen Mitchell
(74) *Attorney, Agent, or Firm*—Barnes & Thornburg

(57) ABSTRACT

A transfer apparatus for moving a patient from a first support to a second support includes an upper platform, a lower conveyor and an actuator configured to be coupled to the lower conveyor to drive the lower conveyor. The lower conveyor is movable such that movement of the lower conveyor to move the apparatus from the second support to the first support moves the patient from the first support onto the upper platform.

29 Claims, 14 Drawing Sheets

U.S. PATENT DOCUMENTS 5,469,588 A 11/1995 DiMatteo et al.
5,535,459 A 7/1996 DiMatteo et al.
5,540,321 A * 7/1996 Foster ..... 198/321
5,577,279 A 11/1996 Foster et al.
5,819,339 A 10/1998 Hodgetts
5,850,642 A 12/1998 Foster
5,855,207 A 1/1999 Moenning et al.
5,937,456 A 8/1999 Norris
5,996,144 A * 12/1999 Hodgetts ..... 5/81.1 HS
6,012,183 A 1/2000 Brooke et al.
6,289,533 B1 * 9/2001 Hodgetts ..... 5/81.1 R

* cited by examiner

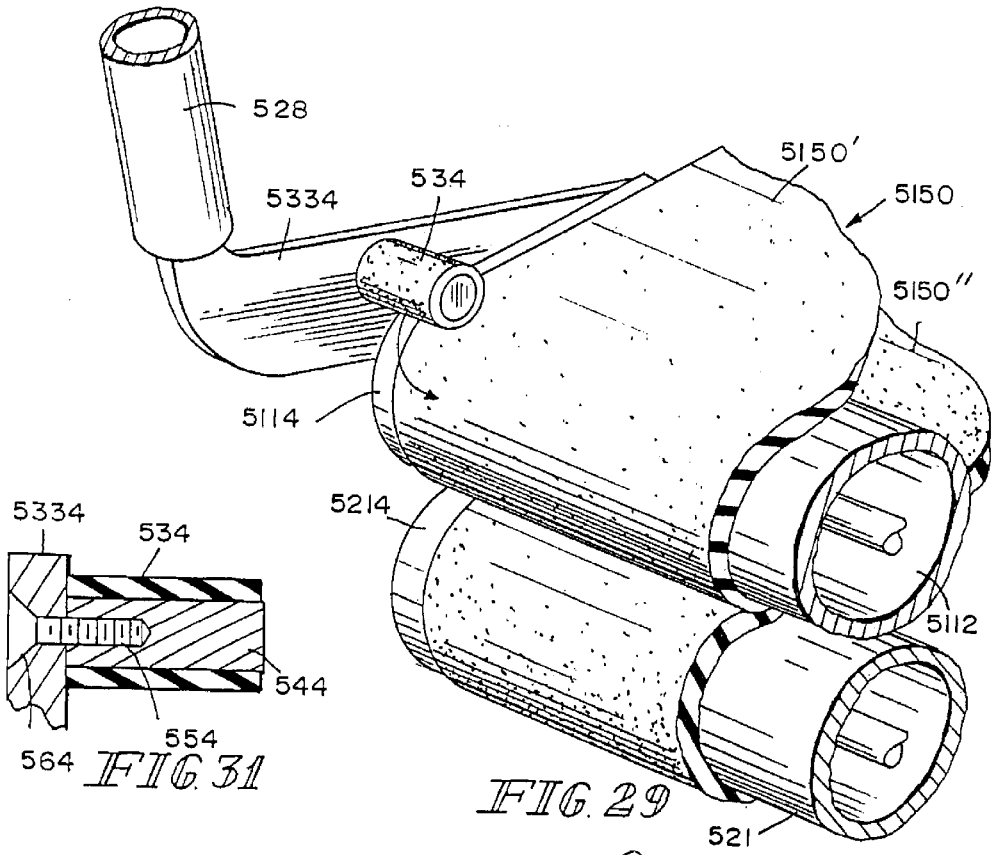
FIG. 29
FIG. 31
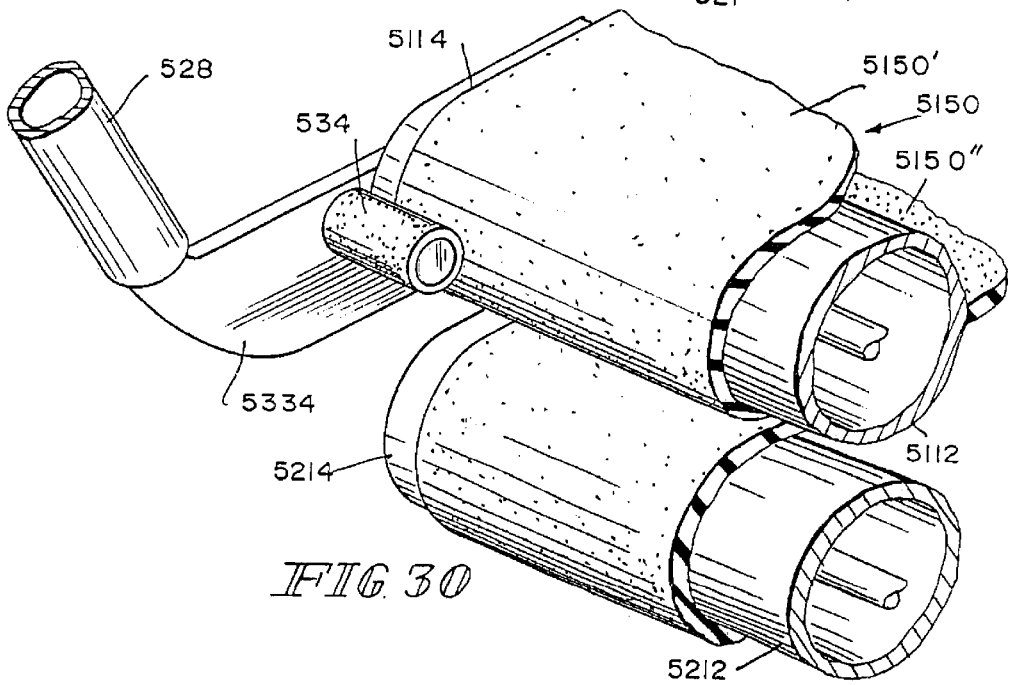
FIG. 30

PATIENT TRANSFER APPARATUS

This application claims the benefit of a U.S. Provisional patent application, Ser. No. 60/193,891, filed on Mar. 31, 2000, and entitled "PATIENT TRANSFER APPARATUS", and a U.S. Provisional patent Application, Serial No. 60/222,244, filed on Aug. 1, 2000, and also entitled "PATIENT TRANSFER APPARATUS", both of which being incorporated herein by reference.

BACKGROUND AND SUMMARY OF THE INVENTION

The present invention generally relates to a patient transfer apparatus, and more particularly relates to a patient transfer apparatus to facilitate transfer of a patient from one support surface, such as a stretcher, to another adjacent support surface, such as a hospital bed or an operating table.

Several devices exist for the purpose of transferring less mobile and totally immobile residents or patients from one support surface, such as a stretcher, to another adjacent support surface, such as a hospital bed in a nursing home or a medical facility. One such resident transfer device is disclosed in the U.S. Pat. No. 6,012,183, entitled "Resident Transfer Apparatus", which is incorporated herein by reference. The therein-disclosed device includes a sheet of material formed as a continuous loop having a low-friction inner surface so that when placed under the resident, two slick surfaces slide against each other reducing the coefficient of friction and making it easier to transfer the resident. The device includes a plurality of spaced-apart handles around the outer surface of the sheet to enable the caregiver to roll the sheet of material over itself toward the second support surface to transfer the resident from the first support surface to the second support surface.

Another such device for moving less mobile and totally immobile residents or patients is illustratively disclosed in the U.S. Pat. No. 5,067,189, issued to Weedling et al. and entitled "Air Chamber Type Patient Mover Air Pallet With Multiple Control Features". The air pallet-type patient mover of Weedling et al. includes a thin flexible bottom sheet for defining an air chamber, with the bottom sheet having pinhole-type perforations through which air escapes under pressure to create an air bearing between the bottom sheet and the underlying support surface to facilitate transfer of patients.

According to the present invention, a patient transfer apparatus includes an upper platform, a lower conveyor and an actuator configured to be coupled to the lower conveyor to drive the lower conveyor. The lower conveyor is movable such that movement of the lower conveyor to move the apparatus toward a support on which a patient is resting moves the patient from the support onto the upper platform.

In preferred embodiments, a patient transfer apparatus includes an upper conveyor, a lower conveyor, an adjustment mechanism configured to movably support the upper conveyor relative to the lower conveyor, and an actuator configured to be coupled to the lower conveyor to drive the lower conveyor. The upper conveyor is movable to engage the lower conveyor to couple the motion of the lower conveyor to the upper conveyor such that movement of the lower conveyor to move the apparatus toward a first support on which a patient is resting moves the upper conveyor to move the patient onto the upper conveyor.

In accordance with another aspect of the illustrative embodiment, a patient transfer apparatus includes an upper conveyor, a lower conveyor, and an adjustment mechanism configured to raise and lower the upper conveyor relative to the lower conveyor between a raised disengaged position in which the upper conveyor is spaced apart from the lower conveyor and a lowered engaged position in which the upper conveyor engages the lower conveyor to couple the motion of the lower conveyor to the upper conveyor such that when the lower conveyor is driven to move under the patient, the upper conveyor is driven to move the patient onto the upper conveyor.

According to still another aspect of the illustrative embodiment, an apparatus for transferring a patient from a first support to a second support configured to be positioned alongside the first support includes upper and lower structures to be placed on the second support to extend alongside the patient on the first support. The upper structure includes laterally spaced-apart, elongated upper side members and an endless conveyor web trained about the side members to provide an upper flight and a lower flight. The upper conveyor web is movable about the upper side members to provide a movable support for patient. The lower structure includes laterally spaced-apart, elongated lower side members and an endless conveyor web trained about the lower side members to provide an upper flight and a lower flight. The lower conveyor web is movable about the lower side members to move the apparatus relative to the second support. The upper conveyor web and the lower drive web are configured to be operatively connected such that movement of the lower conveyor web about the lower side members to move the apparatus from the second support to the first support moves the upper conveyor web about the upper side members to move the patient from the first support onto the upper conveyor.

In accordance with a further aspect of the illustrative embodiment, a transfer mechanism for moving a patient from a first support to a second support includes an assembly to be placed on the second support between the head and foot ends thereof to be positioned alongside the patient on the first support. The assembly includes an upper conveyor and a lower conveyor and an adjustment mechanism configured to raise and lower the upper conveyor relative to the lower conveyor. Each conveyor includes laterally spaced, longitudinally extending side members and an endless conveyor web trained about the side members. The upper conveyor web is movable to engage the lower conveyor web to couple the motion of the lower conveyor web to the upper conveyor web such that the patient is moved from the first support onto the upper conveyor by the web of the upper conveyor and the assembly is moved from the second support to the first support and under the patient by the web of the lower conveyor.

Additional features and advantages of the present invention will become apparent to those skilled in the art upon consideration of the following detailed description of preferred embodiments exemplifying the best mode of carrying out the invention as presently perceived.

BRIEF DESCRIPTION OF THE DRAWINGS

The detailed description particularly refers to the accompanying figures in which:

FIG. 29 is a perspective view showing the upper conveyor web trained about the upper rear roller, the lower conveyor web trained about the lower drive roller, the lift handle of the four-bar linkage moved to the forward position, and the brake pad coupled to the lift handle spaced apart from the upper conveyor web, FIG. 30 is a perspective view similar to FIG. 29, and showing the lift handle of the four-bar linkage moved to the retracted position, and the brake pad pressed against the upper conveyor web to lock it in place, FIG. 31 is a sectional view showing the attachment of the brake pad to the lift handle.

DETAILED DESCRIPTION OF THE DRAWINGS

Figure 4:
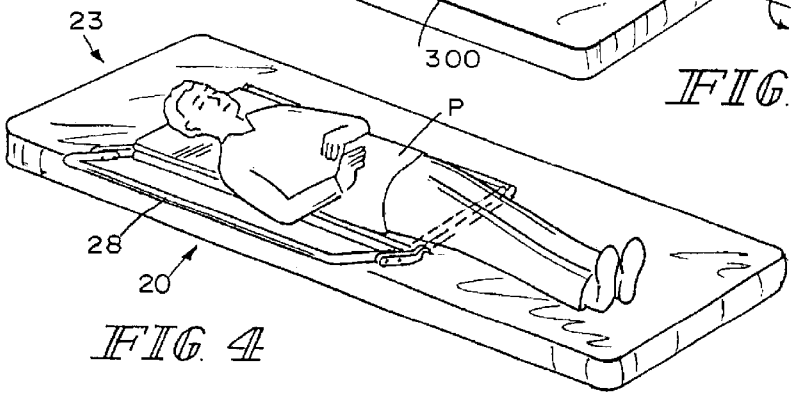
FIG. 4 is a perspective view showing the patient successfully positioned on the second support.
Figure 5:
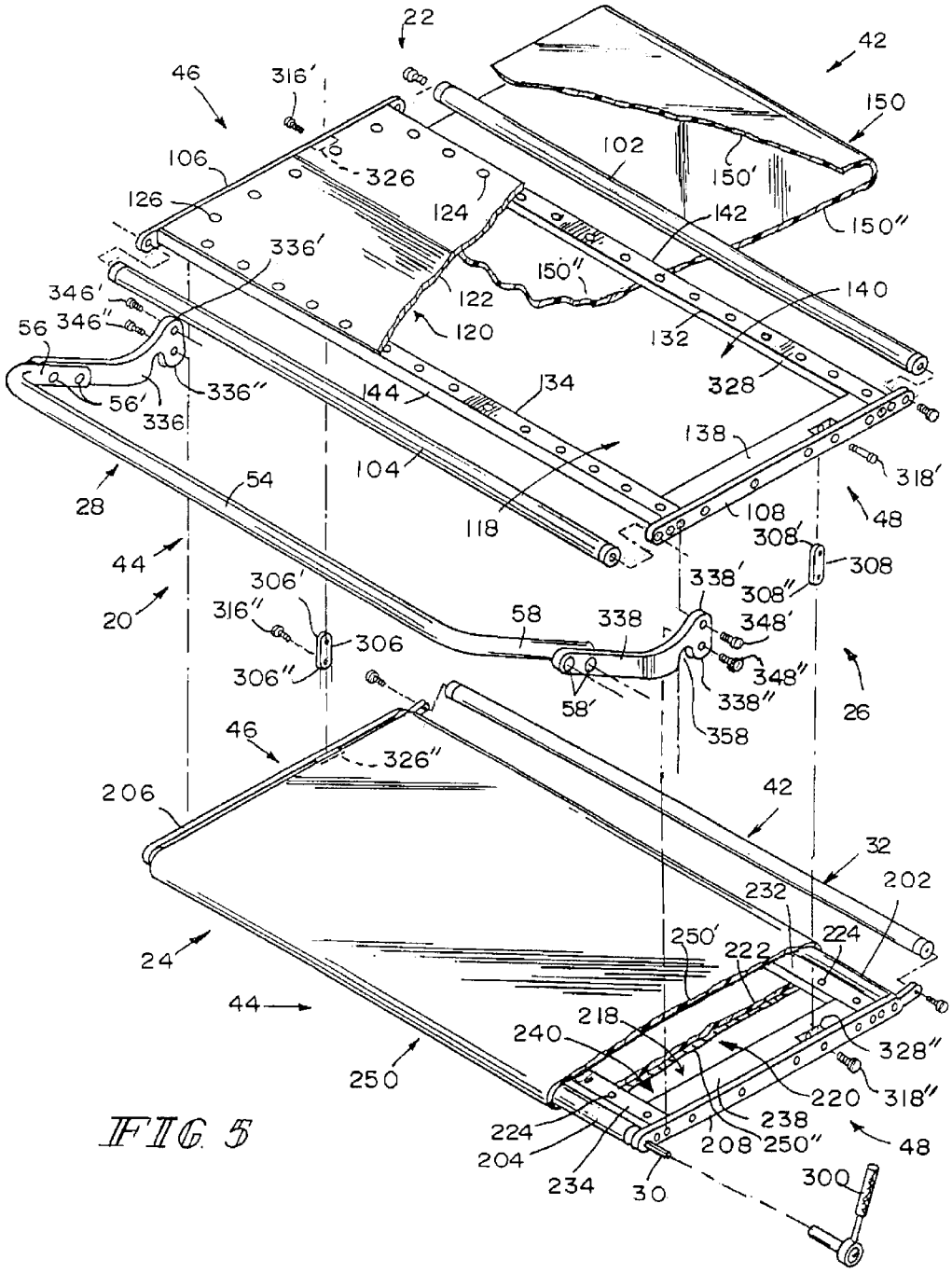
FIG. 5 is an exploded perspective view of a first embodiment of the patient transfer apparatus, and showing an upper conveyor assembly, a lower conveyor assembly, a four-bar linkage movably connecting the upper conveyor assembly to the lower conveyor assembly, a lift handle coupled to the four-bar linkage for moving the upper conveyor assembly between a raised disengaged position and a lowered engaged position, a front idler roller assembly coupled to the lower conveyor assembly to facilitate movement of the patient onto the upper conveyor assembly and an actuator configured to be coupled to the lower conveyor assembly to drive the lower conveyor assembly, the upper conveyor assembly including a pair of laterally spaced-apart, elongated upper side rollers, an upper platen assembly extending between the upper side rollers and an endless conveyor web trained about the pair of upper side rollers to provide an upper flight and a lower flight, the lower conveyor assembly also including a pair of laterally spaced-apart, elongated lower side rollers, a lower platen assembly extending between the lower side rollers and an endless drive conveyor web trained about the pair of lower side rollers to provide an upper flight and a lower flight.

FIGS. 1–15 show a first embodiment 20 of the patient transfer apparatus to assist in the transfer of a patient "P" from a first patient support 21, such as a stretcher, to a second patient support 23, such as a hospital bed, or an operating table. As shown in FIG. 5, the patient transfer apparatus 20 includes an upper conveyor assembly 22, a lower conveyor assembly 24, a four-bar linkage adjustment mechanism 26 movably connecting the upper conveyor assembly 22 to the lower conveyor assembly 24, a lift handle 28 coupled to the four-bar linkage 26 for moving the upper conveyor assembly 22 between a lowered engaged position shown in FIGS. 1, 2 and 6 where the upper patient conveyor web 150 engages the lower drive conveyor web 250 to couple the motion of the lower conveyor web 250 to the upper conveyor web 150 and a raised disengaged position shown in FIGS. 3, 4 and 7 where the upper conveyor web 150 is spaced from the lower conveyor web 250, a drive shaft 30 configured to be coupled to a driver actuator 300 to drive the lower conveyor assembly 24, and a front idler roller assembly 32 located adjacent to the front edge of the apparatus 20 to facilitate movement of the patient onto the upper conveyor assembly 22. As used in this description, the terms "upper" and "top" are used interchangeably, and the terms "lower" and "bottom" are used interchangeably.

The patient transfer apparatus 20 is generally rectangular in configuration having a length dimension 50 and a width dimension 52. The patient transfer apparatus 20 is dimensioned to comfortably support a patient during the transfer of the patient to and from a patient support—such as a hospital bed. Illustratively, the length dimension 50 of the patient transfer apparatus 20 is about 30 inches (76 centimeters), and the width dimension 52 is about 14 inches (36 centimeters). The height of the patient transfer apparatus 20 is about 2½ inches ( 6 centimeters). The height of the patient transfer apparatus 20 including the lift handle 28 is about 9 inches (23 centimeters).

Figure 6:
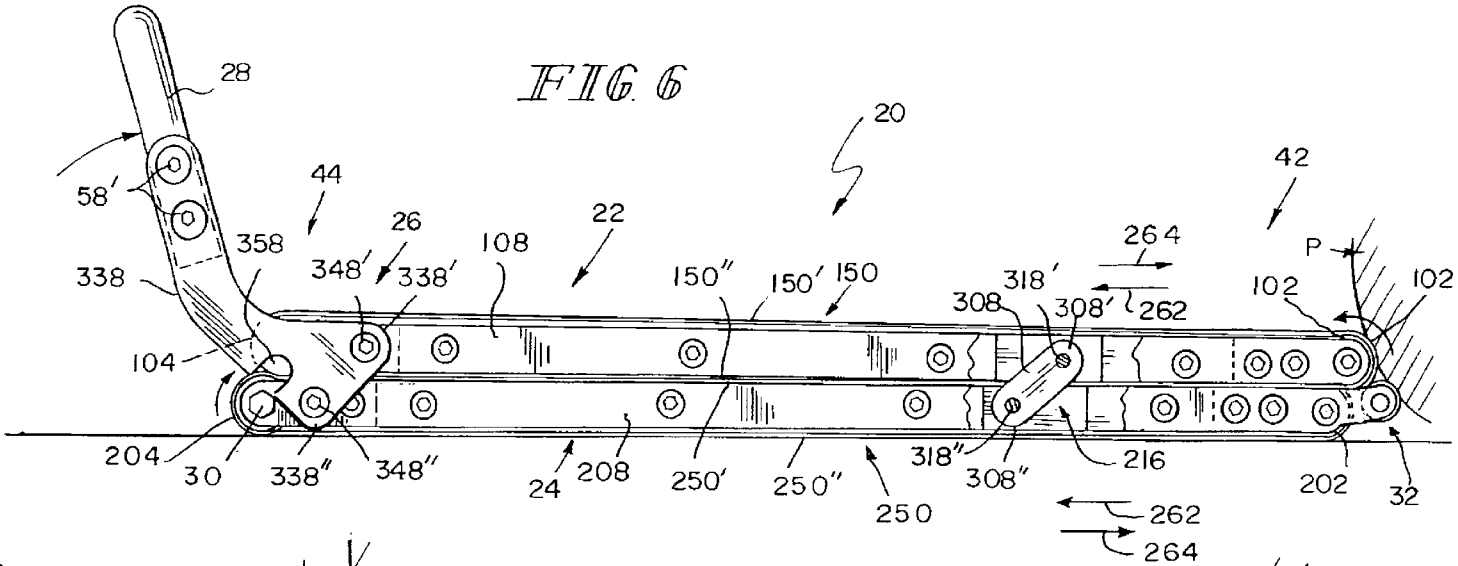
FIG. 6 is an end view of the patient transfer apparatus of FIG. 5 showing the lift handle moved to a forward position to move the upper conveyor assembly to the lowered engaged position to cause the lower flight of the upper conveyor web to engage the upper flight of the lower drive web, the upper conveyor web being movable about the upper side rollers to provide a movable support for patient, the lower drive web being movable about the lower side rollers to move the apparatus relative to the first and second supports, the upper conveyor assembly being shown located forwardly and downwardly and closer to the front edge of the apparatus.
Figure 7:
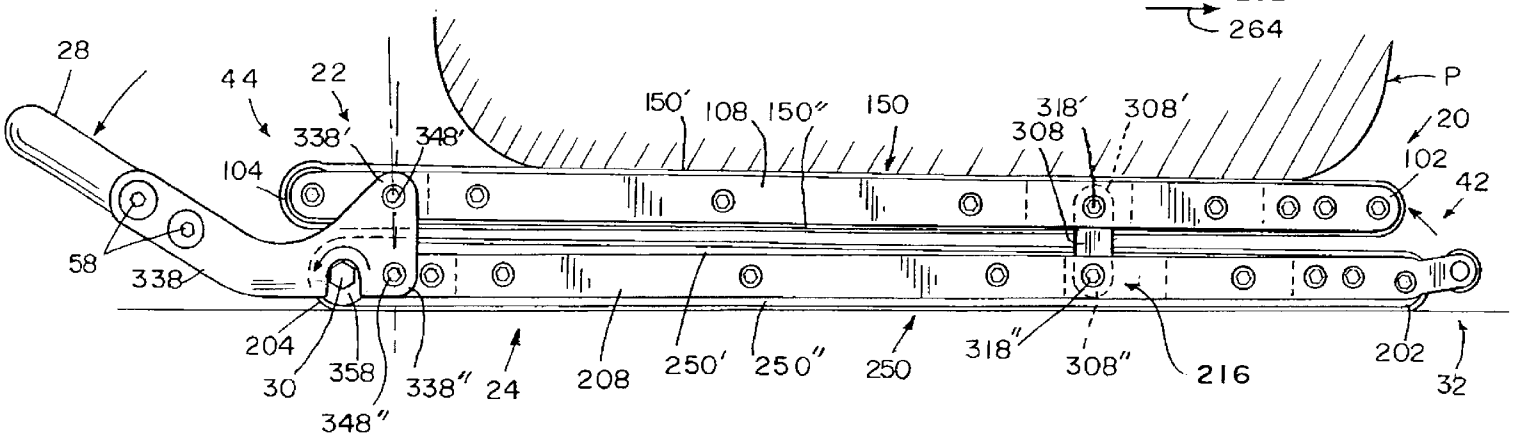
FIG. 7 is an end view similar to FIG. 6, and showing the lift handle moved to a retracted position to lift the upper conveyor assembly to the raised disengaged position to disengage the lower flight of the upper conveyor web from the upper flight of the lower drive web, and further showing the upper conveyor assembly located rearwardly from the lower conveyor assembly past its over-the-center position against a stop bar to hold the upper conveyor assembly in place.

As shown in FIGS. 5–7, the patient transfer apparatus 20 includes an elongated front side 42, an elongated rear side 44, a first head end 46 and a second foot end 48. As used in this description, the phrase "front side 42" will be used to denote the side of any referred-to object that is positioned to lie nearest the front side 42 of the patient transfer apparatus 20, and the phrase "rear side 44" will be used to denote the side of any referred-to object that is positioned to lie nearest the rear side 44 of the patient transfer apparatus 20. Likewise, the phrase "first end 46" will be used to denote the end of any referred-to object that is positioned to lie nearest the first end 46 of the patient transfer apparatus 20, and the phrase "second end 48" will be used to denote the end of any referred-to object that is positioned to lie nearest the second end 48 of the patient transfer apparatus 20.

The upper conveyor assembly 22 includes a pair of laterally spaced-apart, longitudinally-extending idler side member rollers 102, 104, each having its opposite ends rotatably coupled to a pair of longitudinally spaced-apart, laterally-extending end rails 106, 108. Flanged radial bearings 110 at opposite ends of the end rails 106, 108 rotatably support the idler rollers 102, 104. Although flanged radial bearings 110 are used for rotatably supporting the idler rollers 102, 104 in the illustrated embodiment, it is within the scope of the invention as presently perceived to use any suitable means, such as ball bearings, bushings, and so on, for rotatably supporting the guide rollers 102, 104. Also, it is within the scope of the invention as presently perceived to replace the pair of rotatably-mounted idler rollers 102, 104 with a pair of nonrotatably-mounted cylindrical members of appropriate low friction material, each cylinder having its opposite ends fixed to the respective end of the laterally-extending end rails 106, 108. Alternatively, it is within the scope of the invention as presently perceived to replace one of the rotatably-mounted idler rollers 102, 104 with such a cylinder.

Figure 9:
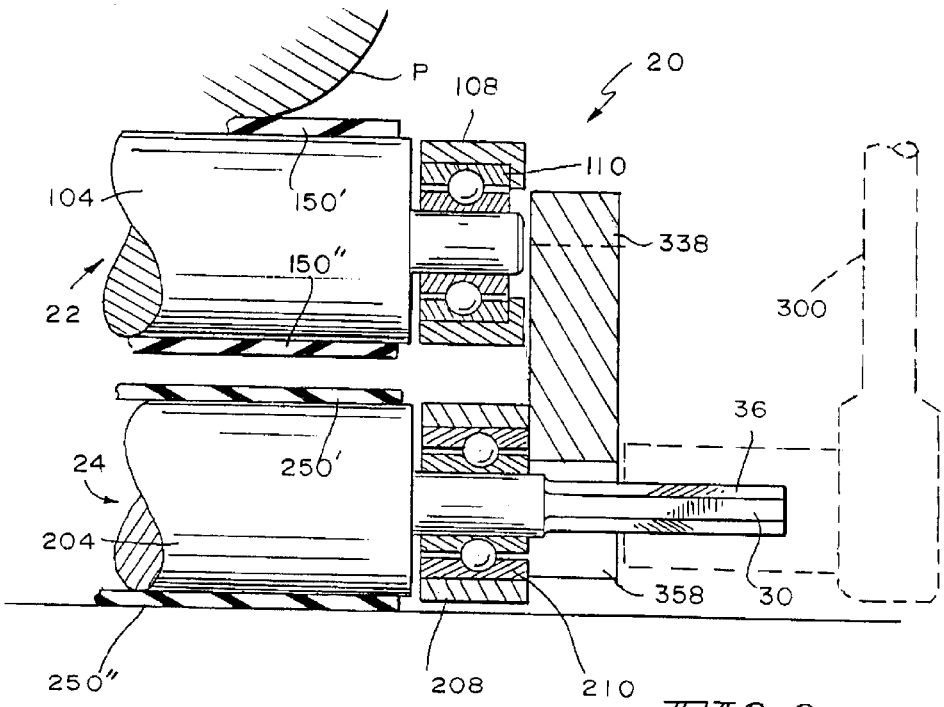
FIG. 9 is a partial sectional side view corresponding to FIG. 7 of the patient transfer apparatus, showing the upper conveyor assembly in the raised disengaged position with the lower flight of the upper conveyor web spaced apart from the upper flight of the lower drive web.
Figure 10:
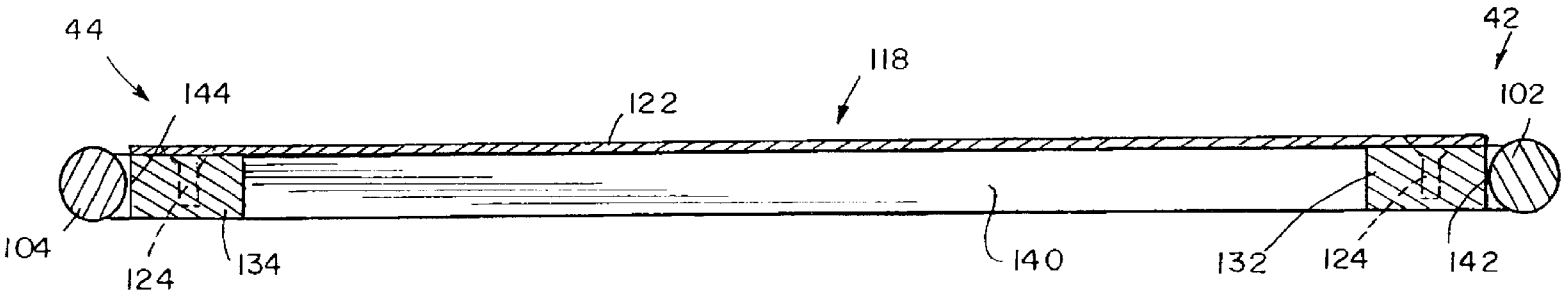
FIG. 10 is a sectional end view of the upper platen assembly positioned between the laterally spaced upper side rollers.
Figure 11:
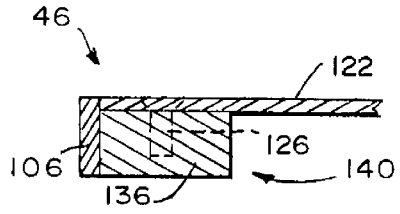
FIGS. 11 and 12 are partial sectional side views showing construction of the upper platen assembly.
Figure 12:
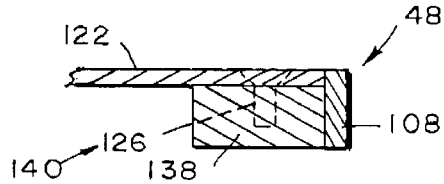

As shown in FIGS. 5 and 10, a platen support structure assembly 120 is received in the space 118 between the idler rollers 102, 104. The platen assembly 120 includes a generally rectangular top plate or panel 122. A pair of longitudinally-extending bars or supports 132, 134 are secured to the underside of the panel 122 along opposite sides 42, 44 thereof by a plurality of screws 124. As shown in FIGS. 5, 11 and 12, the end rails 106, 108 are each provided with laterally-extending blocks 136, 138 which are received in the space 140 formed between the longitudinally-extending supports 132, 134 of the platen assembly 120 at the respective opposite ends 46, 48 thereof. The blocks 136, 138 are secured to the underside of the top panel 122 along opposite ends 46, 48 thereof by a plurality of screws 126. The longitudinally-extending supports 132, 134 and the laterally-extending blocks 136, 138 form a picture frame-like structure for supporting the rectangular top panel 122. The outer side edges 142, 144 of the platen assembly 120 are adjacent to the respective longitudinally-extending idler rollers 102, 104, but are spaced therefrom so as not to interfere with rotation of the idler rollers 102, 104. An endless upper conveyor web 150 is trained about the front and rear idler rollers 102, 104 to provide an upper run or flight 150' and a lower run or flight 150 " as shown in FIGS. 5–9.

The lower conveyor assembly 24 is generally a mirror image of the upper conveyor assembly 22. Referring to FIGS. 5–7, the lower conveyor assembly 24 includes a longitudinally-extending idler roller 202 and a laterally spaced-apart, longitudinally-extending drive roller 204. The opposite ends of the longitudinally-extending rollers 202, 204 are rotatably coupled to a pair of longitudinally spaced-apart, laterally-extending end rails 206, 208. Flanged roller bearings 210 at opposite ends of the end rails 206, 208 rotatably support the guide rollers 202, 204. Although flanged radial bearings 210 are used for rotatably supporting the rollers 202, 204 in the particular embodiment described herein, it is within the scope of the invention as presently perceived to use any suitable means, such as ball bearings, bushings and so on, for rotatably supporting the guide rollers 202, 204. Also, it is within the scope of the invention as presently perceived to replace the rotatably-mounted idler roller 202 located adjacent to the front side 42 of the patient transfer apparatus 20 with a nonrotatably-mounted cylinder of, for example, appropriate low friction material.

Figure 13:
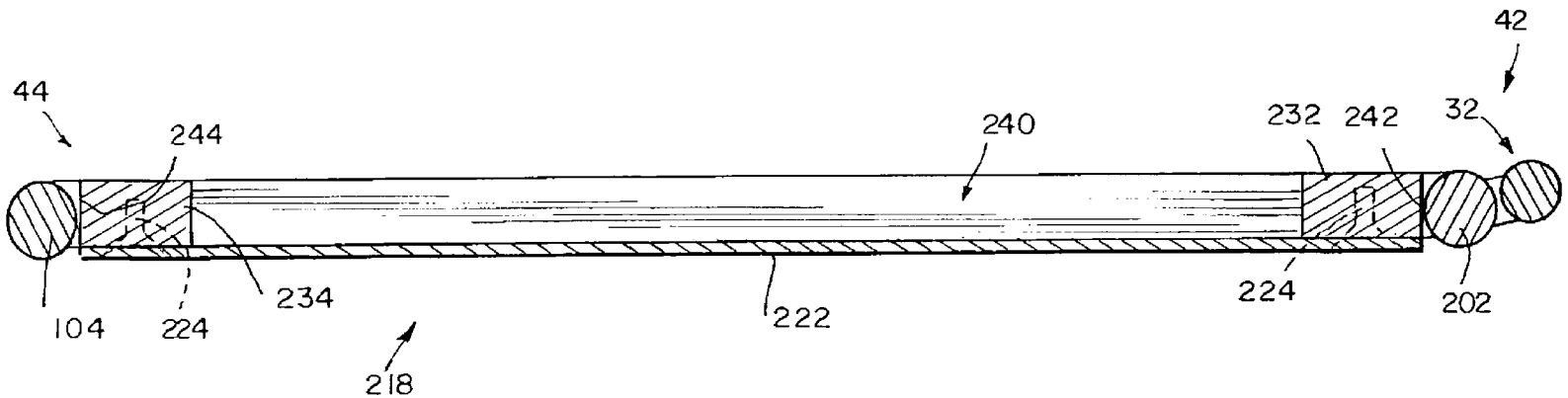
FIG. 13 is a sectional end view similar to FIG. 10 of the lower platen assembly positioned between the lower side rollers, the lower platen assembly being generally a mirror image of the upper platen assembly.
Figure 14:
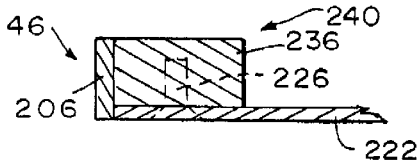
FIGS. 14 and 15 are partial sectional side views similar to FIGS. 11 and 12, showing construction of the lower platen assembly.
Figure 15:
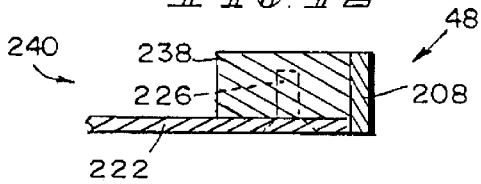

As shown in FIGS. 5 and 13, a platen assembly 220 is received in the space 218 between the guide rollers 202, 204. The platen assembly 220 includes a generally rectangular bottom plate or panel 222. A pair of longitudinally-extending bars or supports 232, 234 are secured to the topside of the bottom panel 222 along opposite sides 42, 44 thereof by a plurality of screws 224. As shown in FIGS. 5, 14 and 15, the end rails 206, 208 are each fitted with laterally-extending blocks 236, 238 which are received in the space 240 formed between the longitudinally-extending supports 232, 234 of the platen assembly 220. The blocks 236, 238 are secured to the topside of the bottom panel 122 along opposite ends 46, 48 thereof by a plurality of screws 226. The longitudinally-extending supports 232, 234 and the laterally-extending blocks 236, 238 form a picture frame-like structure for supporting the rectangular bottom panel 222. The outer side edges 242, 244 of the platen assembly 220 are adjacent to the respective longitudinally-extending guide rollers 202, 204, but are spaced therefrom so as not to interfere with rotation of the rollers 202, 204.

Figure 8:
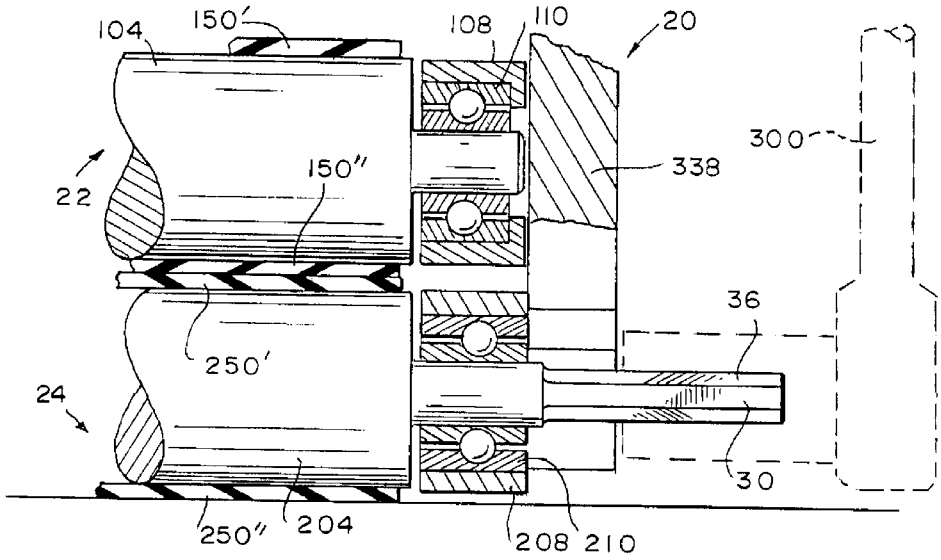
FIG. 8 is a partial sectional side view corresponding to FIG. 6 of the patient transfer apparatus, with the lower flight of the upper conveyor web shown in engagement with the upper flight of the lower drive web to transmit the motion of the lower drive web to the upper conveyor web.

As shown in FIGS. 5–9, an endless conveyor web 250 is trained about the front idler roller 202 and the rear drive roller 204 to provide an upper run or flight 250'and a lower run or flight 250". An actuator 300 is configured to be coupled to the rear drive roller 204 near the foot end 48 of the patient transfer apparatus 20 to drive the lower conveyor 250. As shown in FIGS. 8 and 9, the rear drive roller 204 includes a drive shaft 30 extending through the lower end rail 208 adjacent to the foot end 48 of the patient transfer apparatus 20. The drive shaft 30 has a hexagonal head portion 36 to facilitate the use of a mechanical socket wrench (or a lever with a ratchet mechanism) to turn the rear drive roller 204 to, in turn, drive the lower conveyor web 250. The rear drive roller 204 may be bead blasted or overcoated with suitable material to give its outer surface a textured finish to enhance its grip on the lower conveyor web 250. Likewise, other rollers 102, 104, 202 may be bead blasted or overcoated with a suitable coating to give their outer surfaces a textured finish.

Although a mechanical device such as a socket wrench or a lever is used in the illustrated embodiment for driving the lower conveyor web 250, it will however be appreciated that other types of actuators may well be used to drive the conveyor web 250 without exceeding the scope of the invention as presently perceived. Various types of mechanical, electromechanical, hydraulic, and pneumatic actuators or drives may be used to drive the rear drive roller 204. As a result, the term "actuator" in the specification and in the claims is intended to cover all types of mechanical, electromechanical, hydraulic, and pneumatic drives, including manual cranking mechanisms of all types and including combinations of the above elements for rotating the rear drive roller 204.

As shown in FIGS. 5–7, the four-bar linkage 26 movably connects the upper conveyor assembly 22 to the lower conveyor assembly 24. The lift handle 28 is coupled to the four-bar linkage 26 for moving the upper conveyor assembly 22 between a raised disengaged position shown in FIGS. 7, 9 and a lowered engaged position shown in FIGS. 6, 8. The four bar linkage 26 includes a pair of swing arms or links 306, 308 adjacent to the front side 42 of the patient transfer apparatus 20. The links 306, 308 have their respective ends 306', 306" and 308', 308" pivotally coupled to the upper and lower conveyor assemblies 22, 24. The top end 306' of the first link 306 is pivotally coupled to the top end rail 106 adjacent to the head end 46 by a pivot pin 316'. The bottom end 306" of the first link 306 is pivotally coupled to the bottom end rail 206 by a pivot pin 316". Likewise, the top end 308' of the second link 308 is pivotally coupled to the top end rail 108 adjacent to the foot end 48 by a pivot pin 318'. The bottom end 308" of the second link 308 is pivotally coupled to the bottom end rail 208 adjacent to the foot end 48 by a pivot pin 318". The links 306, 308 are mounted on the inside of the top and bottom end rails 106, 206 and 108, 208 adjacent to the front side 42 of the patient transfer apparatus 20. The top and bottom blocks 136, 236 adjacent to the first end 46 of the patient transfer apparatus 20 are provided with respective cutouts 326', 326" to accommodate swinging motion of the first link 306. Similarly, the top and bottom blocks 138, 238 adjacent to the second end 48 of the patient transfer apparatus 20 are provided with respective cutouts 328', 328" to accommodate swinging motion of the second link 308.

The four bar linkage 26 further includes a pair of handle brackets 336, 338 adjacent to the rear side 44 of the patient transfer apparatus 20. The handle brackets 336, 338 have their respective ends 336', 336" and 338', 338' pivotally coupled to the upper and lower conveyor assemblies 22, 24. The top end 336' of the first handle bracket 336 is pivotally coupled to the top end rail 106 by a pivot pin 346'. The bottom end 336" of the first handle bracket 336 is pivotally coupled to the bottom end rail 206 by a pivot pin 346". Likewise, the top end 338' of the second handle bracket 338 is pivotally coupled to the top end rail 108 by a pivot pin 348'. The bottom end 338" of the second handle bracket 338 is pivotally coupled to the bottom end rail 208 by a pivot pin 348". As shown in FIGS. 6–9, the handle brackets 336, 338 are mounted on the outside of the top and bottom end rails 106, 206 and 108, 208 adjacent to the rear side 44 of the patient transfer apparatus 20. The lift handle 28 includes a middle portion 54 and end portions 56, 58. The end portions 56, 58 of the lift handle 28 are secured to the respective handle brackets 336, 338 by means of screws 56', 58'. The handle bracket 338 near the foot end 48 includes a slot 358 through which the drive shaft 30 extends beyond the end rail 208 near the rear side 44 of the patient transfer apparatus 20. The slot 358 is sufficiently large to allow free turning of the drive shaft 30 without interference from the handle bracket 338.

The lift handle 28 is movable between a forward position shown in FIGS. 6 and 8, and a retracted position shown in FIGS. 7 and 9. The four-bar linkage 26 is configured such that the upper conveyor assembly 22 is spaced upwardly from the lower conveyor assembly 24, and located rearwardly therefrom, when the lift handle 28 is moved to the retracted position as shown in FIG. 7. On the other hand, when the lift handle 28 is moved to the forward position, the upper conveyor assembly 22 is lowered to engage the lower conveyor assembly 24, and located forwardly therefrom closer to the front side 42 of the patient transfer apparatus 20 as shown in FIG. 6. Furthermore, the four-bar linkage 26 is configured such that the upper conveyor assembly 22 is positioned rearwardly, slightly to the left of over-the-center position with respect to the lower conveyor assembly 24 as shown in FIG. 7 to hold the upper conveyor assembly 22 in place against a stop bar (not shown). The front idler roller assembly 32 is rotatably coupled to the bottom end rails 206, 208, and is located forwardly and downwardly with respect to the upper conveyor assembly 22 to facilitate movement of the patient onto the upper conveyor assembly 22 as shown in FIG. 6. The front idler roller assembly 32 is optional, and may be eliminated. Although a four-bar linkage 26 is used for lifting and lowering the upper conveyor assembly 22 relative to the lower conveyor assembly 24, it will be understood that any suitable mechanism may well be used for adjustably moving the upper conveyor assembly 22 relative to the lower conveyor assembly 24.

Illustratively, the dimensions and materials used in the particular embodiment described above are as follows: The rear idler roller 104 and the rear drive roller 204 are both about 1 inch (2.54 centimeters) in diameter, and are made from stainless steel. The front idler rollers 102, 202 are both about ⅝ inches (1.59 centimeters) in diameter, and are made from aluminum. The end rails 106, 108, 206, 208, the longitudinal supports 132, 134, 232, 234, the end blocks 136, 138, 236, 238, the links 306, 308, the handle brackets 336, 338, the lift handle 28 are all made from aluminum. The top and bottom panels 122, 222 are made from a carbon fiber composite. The upper and lower conveyors 150, 250 are both made from Lectrolite Duotone material.

Figure 1:
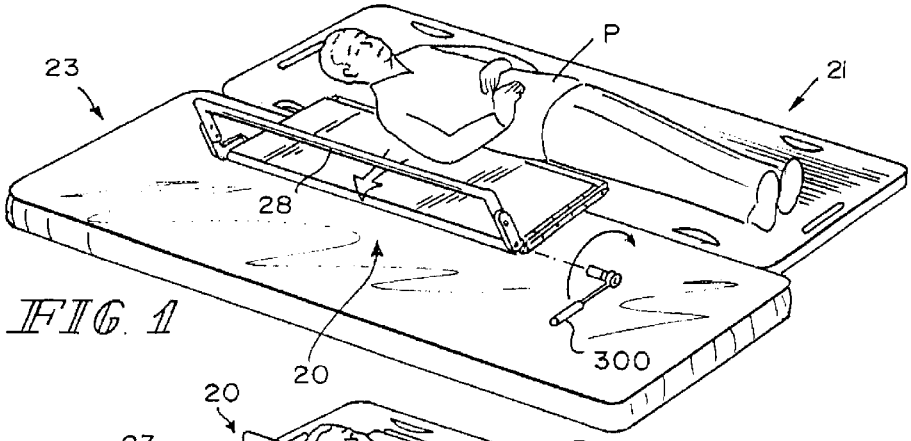
FIG. 1 is a perspective view showing a patient located on a first support and a patient transfer apparatus located on a second support positioned alongside the patient on the first support prior to the transfer of the patient from the first support to the second support.
Figure 2:
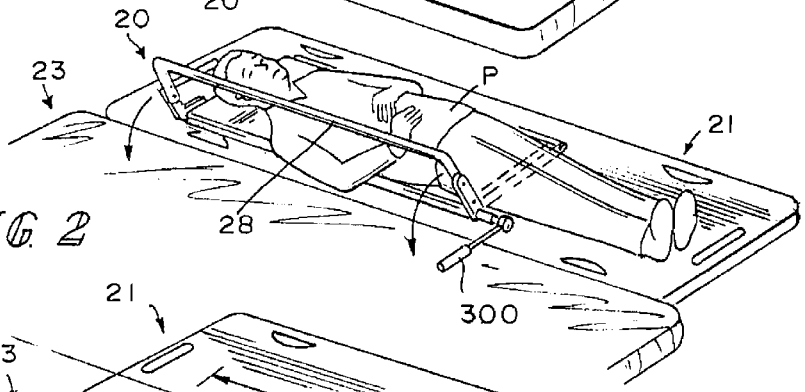
FIG. 2 is a perspective view showing the patient transfer apparatus moved to the first support, and under the patient.

The operation of the patient transfer device 20 will now be explained with reference to FIGS. 1–4. To transfer a patient from a first support 21, for example a stretcher, to a second support 23, for example a hospital bed, the first support 21 with the patient resting thereon is positioned next to the second support 23 to which the patient is to be transferred. The patient transfer device 20 is placed on the second support 23 between the head and foot ends thereof alongside the patient on the first support 21 as shown in FIG. 1, and the lift handle 28 is pushed forward as shown in FIGS. 6 and 8 to lower the upper conveyor assembly 22 onto the lower conveyor assembly 24. When the upper conveyor assembly 22 is lowered, the lower run 150" of the upper patient conveyor 150 engages the upper run 250' of the lower drive conveyor 250 as shown in FIGS. 6 and 8 to transmit the motion of the lower drive conveyor 250 to the upper patient conveyor 150. An actuator or wrench 300 is then used to turn the lower flight 250" of the lower drive conveyor 250 in a first direction 262 shown in FIG. 6. Motion of the lower flight 250" in the first direction 262 causes the patient transfer apparatus 20 to move toward the first support 21, and causes the upper flight 150' of the upper patient conveyor 150 to also move in the first direction 262. Motion of the upper flight 150' in the first direction 262 moves the patient onto the upper conveyor assembly 22. As a result, the patient transfer apparatus 20 moves onto the first support 21, with the patient supported on the upper conveyor assembly 22 as shown in FIG. 2. The front idler roller assembly 32, being situated forwardly and downwardly relative to the upper conveyor assembly 22, facilitates movement of the patient from the first support 21 onto the upper patient conveyor 150.

Figure 3:
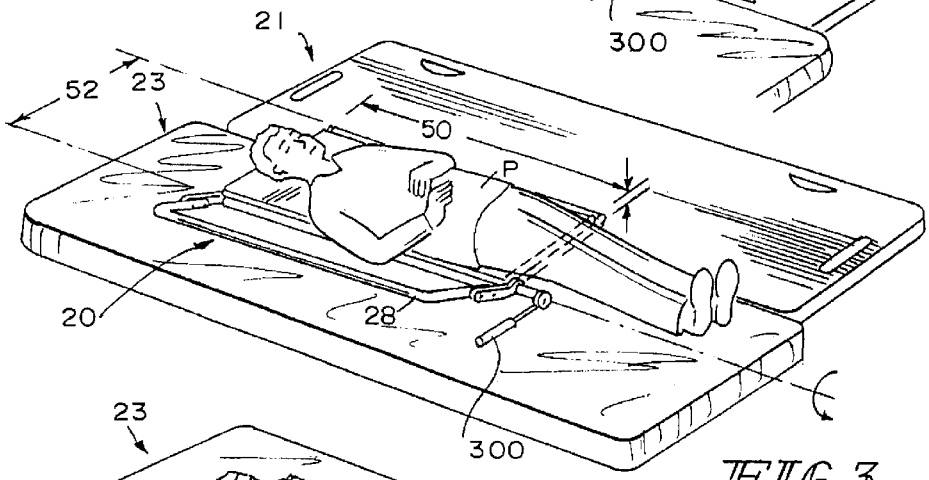
FIG. 3 is a perspective view showing the patient transfer apparatus with the patient thereon being moved back to the second support.

To move the patient to the second support 23, the lift handle 28 is retracted or pulled backward as shown in FIGS. 3, 7 and 9 to lift the upper conveyor assembly 22 with the patient resting thereon above the lower conveyor assembly 24. The actuator 300 is then used to turn the lower flight 250" of the lower drive conveyor 250 in a second direction 264 shown in FIG. 6 to cause the patient transfer apparatus 20 to move toward the second support 23. The upper patient conveyor 150, being disengaged from the lower drive conveyor 250, does not turn. As a result, the patient transfer apparatus 20 with the patient resting thereon moves to the second support 23 as shown in FIG. 4.

To remove the patient transfer apparatus 20 from under the patient and to deposit the patient onto the second support 23, the lift handle 28 is again pushed forward to engage the upper patient conveyor 150 with the lower drive conveyor 250 as shown in FIGS. 6, 8. The actuator 300 is then used to turn the lower flight 250" of the lower drive conveyor 250 in the second direction 264. Motion of the lower flight 250" in the second direction 264 causes the upper flight 150' of the upper patient conveyor 150 to also turn in the second direction 264. As a result, the patient is transferred to the second support 23, and the patient transfer apparatus 20 is moved out from under the patient. A third support, such as a gurney, may be positioned alongside the second support 23 on the side of the second support 23 opposite from the first support 21 to support the weight of the patient transfer apparatus 20 as it comes out from under the patient. The procedure for removing the patient transfer apparatus 20 from under the patient is generally opposite of the procedure for inserting the patient transfer apparatus 20 under the patient.

Figure 16:
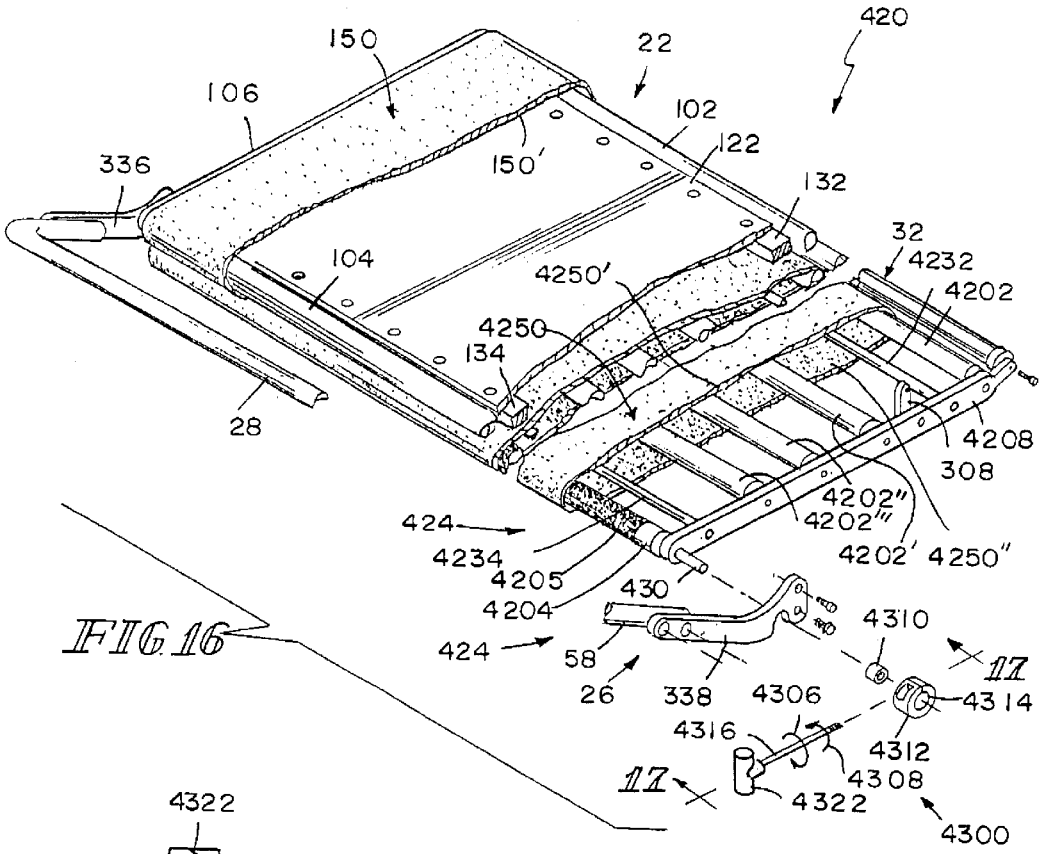
FIG. 16 is a partially broken away and partially exploded perspective view of a second embodiment of the patient transfer apparatus similar to the first embodiment shown in FIGS. 1–15, the FIG. 16 patient transfer apparatus including an upper conveyor assembly, a lower conveyor assembly, a four-bar linkage movably connecting the upper conveyor assembly to the lower conveyor assembly, a lift handle coupled to the four-bar linkage for moving the upper conveyor assembly between a raised disengaged position and a lowered engaged position, a front idler roller assembly coupled to the lower conveyor assembly to facilitate movement of the patient onto the upper conveyor assembly and an actuator configured to be coupled to the lower conveyor assembly to drive the lower conveyor assembly, the upper conveyor assembly including a pair of laterally spaced-apart, elongated upper side rollers, an upper platen assembly extending between the upper side rollers and an endless conveyor web trained about the pair of upper side rollers, the lower conveyor assembly including a plurality of laterally spaced-apart, elongated rollers and an endless drive web trained about the plurality of rollers.

FIG. 16 is a partially broken away and partially exploded perspective view of a second embodiment 420 of the patient transfer apparatus similar to the first embodiment 20 of the patient transfer apparatus shown in FIGS. 1–15. Identical components in the two embodiments are identified by identical numerals. For example, the upper conveyor assembly in both embodiments is identified by numeral 22, the four-bar linkage in both embodiments is identified by numeral 26, and so on. On the other hand, functionally similar components in the two embodiments are identified by similar numerals. For example, the lower conveyor assembly in the second embodiment is identified by numeral 424 while the lower conveyor assembly in the first embodiment is identified by numeral 24. Likewise, the actuator in the second embodiment is identified by numeral 4300 while the actuator in the first embodiment is identified by numeral 300, and so on. The two embodiments are generally identical with the exception of the lower conveyor assembly and the actuator for driving the lower conveyor assembly. Generally speaking, the lower conveyor assembly 24 in the first embodiment includes a pair of laterally spaced-apart, elongated side rollers 202, 204. The lower conveyor assembly 424 in the second embodiment, however, includes a set of five laterally spaced-apart, elongated rollers as explained below.

The second embodiment 420 of the patient transfer apparatus includes the upper conveyor assembly 22, the lower conveyor assembly 424, the four-bar linkage 26 movably connecting the upper conveyor assembly 22 to the lower conveyor assembly 424, the lift handle 28 coupled to the four-bar linkage 26 for moving the upper conveyor assembly 22 between a raised disengaged position and a lowered engaged position, the front idler roller assembly 32 to facilitate movement of the patient onto the upper conveyor assembly 22, and the actuator 4300 configured to be coupled to the lower conveyor assembly 424 to drive the lower conveyor assembly 424. As previously indicated, the front idler roller assembly 32 is optional, and may be eliminated.

Referring to FIG. 16, the lower conveyor assembly 424 in the second embodiment includes a longitudinally-extending front idler roller 4202, a laterally spaced-apart, longitudinally-extending rear drive roller 4204, and a set of three longitudinally-extending intermediate idler rollers 4202', 4202", 4202'" located between the front idler roller 4202 and the rear drive roller 4204. The opposite ends of the longitudinally-extending rollers 4202, 4202', 4202", 4202'", 4204 are rotatably coupled to a pair of longitudinally spaced-apart, laterally-extending end rails 4206, 4208. Flanged radial bearings 4210 coupled to the end rails 4206, 4208 rotatably support the longitudinally-extending rollers 4202, 4202', 4202", 4202'", 4204. Unlike the first embodiment 24, the second embodiment 424 of the lower conveyor assembly does not include a platen assembly between the front idler roller 4202 and the rear drive roller 4204. Instead, a pair of longitudinally-extending spacer bars 4232, 4234 are employed to provide rigidity to the lower conveyor assembly 424. The spacer bars 4232, 4234 are located adjacent to the front idler roller 4202 and the rear drive roller 4204 respectively, and have their opposite ends secured to the end rails 4206, 4208. Although flanged radial bearings 4210 are used for rotatably supporting the rollers 4202, 4202', 4202", 4202'", 4204, it is within the scope of the invention as presently perceived to use any suitable means, such as ball bearings, bushings and so on.

An endless lower conveyor web 4250 is trained about the plurality of lower rollers 4202, 4202', 4202", 4202'", 4204 to provide an upper run or flight 4250' and a lower run or flight 4250". The rear drive roller 204 includes a drive shaft 430 which protrudes through the end rail 4208 adjacent to the foot end 48 of the patient transfer apparatus 420. The actuator 4300 is coupled to the protruding portion of the drive shaft 430 to rotate the rear drive roller 4204 to, in turn, drive the lower conveyor web 4250. The actuator 4300 includes a unidirectional roller clutch to transmit rotation of the actuator 4300 in clockwise locking direction 4302 to the drive shaft 430. Rotation of the actuator 4300 in anticlockwise overrunning direction 4304, however, is not transmitted to the drive shaft 430.

Figure 17:
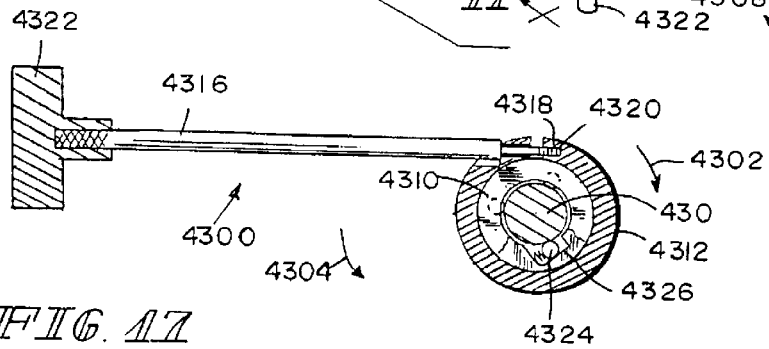
FIG. 17 is a sectional view along line 17—17 in FIG. 16, diagrammatically showing the construction of a roller clutch-type actuator configured to be coupled to the drive roller of the lower conveyor assembly of FIG. 16.

Referring to FIGS. 16 and 17, the actuator 4300 includes a roller clutch 4310 mounted on the drive shaft 430. A C-clip or a nut may be mounted on the drive shaft 430 adjacent to its free end to hold the roller clutch 4310 on the drive shaft 430. A split collar 4312 includes a central opening 4314 for receiving the roller clutch 4310. A swing arm 4316 has a threaded portion 4318 at one end which is screwed into a threaded opening 4320 in the split collar 4312. A knob 4322 is coupled to the distal end of the swing arm 4316. Rotation of the knob 4322 in clockwise direction 4306 pulls the two halves of the split collar 4312 together to, in turn, lock the swing arm 4316 to the roller clutch 4310. Rotation of the knob 4322 in the opposite anticlockwise direction 4308 separates the two halves of the split collar 4312 to, in turn, release the swing arm 4316 from the roller clutch 4310. Suitable releasable fastening means—such as a velcro fastener or a clip (not shown) may be used to attach the swing arm 4316 to a frame member, such as the lift handle 28 or the end rail 4208 to prevent the swing arm 4316 from flopping around when not in use.

The roller clutch 4310 includes a plurality of spring-loaded needle rollers 4324 (for example, 9) disposed between toothed ramp portions 4326 formed on the inner surface of the roller clutch 410 and the outer surface of the drive shaft 430. Rotation of the swing arm 4316 in the locking direction 4302 wedges the rollers 4322 against the outer surface of the drive shaft 430 to lock the roller clutch 4310 to the drive shaft 430 to, in turn, transmit the motion of the swing arm 4316 to the drive shaft 430. Only 3 rollers are shown in the schematic representation in FIG. 17.

Illustratively, the dimensions and materials used in this particular embodiment are as follows: The front idler roller 102 is about ⅝ inches (1.59 centimeters) in diameter, and is made from aluminum. The rear idler roller 104 is about 1 inch (2.54 centimeters) in diameter, and is made from stainless steel. The front idler roller 4202 and the second idler roller 4202' are each about ⅝ inches (1.59 centimeters) in diameter, and are made from aluminum. The third idler roller 4202" is about ¾ inches (1.90 centimeters) in diameter, and is made from aluminum. The fourth idler roller 4202'" is about 1 inch (2.54 centimeters) in diameter, and is made from aluminum. The rear drive roller 4204 is both about 1 inch (2.54 centimeters) in diameter, and is made from stainless steel. Other parts are illustratively made from aluminum.

The operation of the patient transfer device 420 will now be explained with reference to FIGS. 1–4. To transfer a patient from a first support 21, for example a stretcher, to a second support 23, for example a hospital bed, the first support 21 with the patient resting thereon is positioned next to the second support 23 to which the patient is to be transferred. The patient transfer device 420 is placed on the second support 23 between the head and foot ends thereof alongside the patient on the first support 21 as shown in FIG. 1, and the lift handle 28 is pushed forward to lower the upper conveyor assembly 22 onto the lower conveyor assembly 424 to, in turn, engage the upper patient conveyor 150 with the lower drive conveyor 4250. The knob 4322 is turned to lock the swing arm 4316 to the roller clutch 4310. The swing arm 4316 is then moved forward (i.e., toward the patient) and backward (i.e., away from the patient) to turn the lower drive conveyor 4250 to, in turn, move the patient transfer apparatus 420 toward the patient on the first support 21, and to move the patient onto the upper conveyor assembly 22. The front idler roller assembly 32, situated forwardly and downwardly relative to the upper conveyor assembly 22, facilitates movement of the patient from the first support 21 onto the upper conveyor assembly 22.

To move the patient to the second support 23, the lift handle 28 is retracted to lift the upper conveyor assembly 22 above the lower conveyor assembly 424, and to disengage the upper conveyor assembly 22 from the lower conveyor assembly 424 as shown in FIG. 3. The knob 4322 is then turned to loosen the split collar 4312 to, in turn, free the roller clutch 4310. The lift handle 28 is then used to roll the patient transfer apparatus 420 with the patient resting thereon onto the second support 23. The use of flanged radial bearings 4210 for rotatably supporting the bottom rollers 4202, 4202', 4202", 4202'", 4204 makes it easy to roll the patient transfer apparatus 420.

To deposit the patient onto the second support 23 and remove the patient transfer apparatus 420 from under the patient, the lift handle 28 is pushed forward. The lift handle 28 is then used to retract the patient transfer apparatus 420 to allow the patient to gently slide onto the second support 23.

The drive roller 4204 may be bead blasted or overcoated with a suitable coating 4205 to give its outer surface a textured finish to enhance its grip on the lower conveyor 4250. Likewise, other rollers 102, 104, 4202, 4202', 4202", 4202'" may be bead blasted or overcoated with a suitable coating to give their outer surfaces a textured finish. Although a mechanical device such as a roller clutch-type actuator is used in the illustrated embodiment to drive the lower conveyor 4250, it will however be appreciated that other types of actuators may well be used to drive the lower conveyor 4250 without exceeding the scope of the invention as presently perceived.

FIGS. 18–32 show a third embodiment 520 of the patient transfer apparatus similar to the first embodiment 20 shown in FIGS. 1–15 and the second embodiment 420 shown in FIGS. 16 and 17. Referring to FIGS. 18–22, the patient transfer apparatus 520 includes an upper conveyor assembly 522, a lower conveyor assembly 524, a four-bar linkage adjustment mechanism 526 movably connecting the upper conveyor assembly 522 to the lower conveyor assembly 524, a lift handle 528 coupled to the four-bar linkage 526 for moving the upper conveyor assembly 522 between a lowered engaged position shown in FIG. 19 where the upper conveyor assembly 522 engages the lower conveyor assembly 524 when the lift handle 528 is moved to a forward position, and a raised disengaged position shown in FIG. 20 where the upper conveyor assembly 522 is spaced upwardly and rearwardly from the lower conveyor assembly 524 when the lift handle 528 is moved to a retracted position, a drive shaft 530 configured to be coupled to an actuator 5300 to drive the lower conveyor assembly 524, a pair of brake pads 534, 536 coupled to respective lift handle brackets 5334, 5336 and configured to be pressed against the upper conveyor assembly 522 to lock the upper conveyor assembly 522 when the lift handle 528 is moved to the retracted position, and a stop pin 532 against which the handle bracket 5334 near the head end 514 rests when the lift handle 528 is moved to the retracted position. When the lift handle 528 is moved to the forward position shown in FIG. 19, the upper conveyor assembly 522 engages the lower conveyor assembly 524 to couple the motion of the lower conveyor assembly 524 to the upper conveyor assembly 522. Although a four-bar linkage 526 is used for lifting and lowering the upper conveyor assembly 522 relative to the lower conveyor assembly 524, it will be understood that any suitable mechanical, electrical, hydraulic or pneumatic device may well be used for lifting and lowering the upper conveyor assembly 522. The overall dimensions of the patient transfer apparatus 520 are about the same as the first embodiment 20 or the second embodiment 420—the length about 30 inches (76 centimeters), and the width about 14 inches (36 centimeters), the height about 2½ inches (6 centimeters) without the lift handle 528, and about 9 inches (23 centimeters) with the handle 528.

The patient transfer apparatus 520 includes an elongated front side 510, an elongated rear side 512, a head end 514 and a foot end 516. As used in this description, the phrase "front side 510" will be used to denote the side of any referred to object that is positioned to lie nearest the front side 510 of the patient transfer apparatus 520, and the phrase "rear side 512" will be used to denote the side of any referred-to object that is positioned to lie nearest the rear side 512 of the patient transfer apparatus 520. Likewise, the phrase "head end 514" will be used to denote the end of any referred-to object that is positioned to lie nearest the head end 514 of the patient transfer apparatus 520, and the phrase "foot end 516" will be used to denote the end of any referred-to object that is positioned to lie nearest the foot end 516 of the patient transfer apparatus 520.

Figure 23:
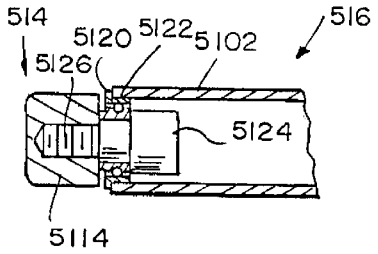
FIG. 23 is a partial sectional end view showing the head end of the upper front roller rotatably coupled to the upper end rail near the head end of the patient transfer apparatus by a flanged radial bearing, the attachment of the foot end of the upper front roller to the upper end rail near the foot end of the patient transfer apparatus being similar, FIG. 24 is a partial sectional end view similar to FIG. 23, and showing the attachment of the head end of the upper second front roller and the enclosed spacer rod to the upper end rail near the head end of the patient transfer apparatus, and showing the head end of the upper second front roller rotatably coupled to the upper end rail near the head end of the patient transfer apparatus by a flanged radial bearing, the attachment of the foot end of the upper second front roller and the enclosed spacer rod to the upper end rail near the foot end of the patient transfer apparatus being similar, FIG. 25 is a partial sectional end view similar to FIGS. 23 and 24, and showing the head end of the upper third front roller rotatably coupled to the upper end rail near the head end of the patient transfer apparatus by a flanged radial bearing, the attachment of the foot end of the upper third front roller to the upper end rail near the foot end of the patient transfer apparatus being similar, FIG. 26 is a partial sectional end view similar to FIGS. 23–25, and showing the attachment of the rear drive roller of the lower conveyor assembly to the lower end rails, and showing the head end of the rear drive roller rotatably coupled to the lower end rail near the head end of the patient transfer apparatus by a flanged radial bearing, and further showing the foot end of the rear drive roller coupled to a drive shaft extending through the end rail near the foot end of the patient transfer apparatus and supported by a needle bearing, the free end of the drive shaft carrying a roller clutch configured to be coupled to the actuator for driving the rear drive roller.
Figure 24:
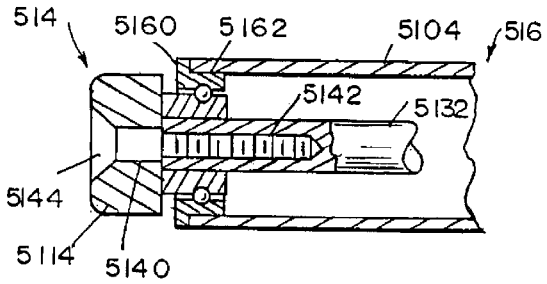
Figure 25:
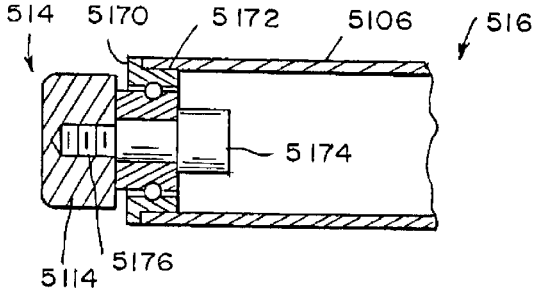

The upper conveyor assembly 522 includes a longitudinally-extending front roller 5102, a laterally spaced-apart, longitudinally-extending rear last roller 5112, and a set of four longitudinally-extending intermediate rollers 5104, 5106, 5108, 5110 located between the front and rear rollers 5102, 5112. The rollers 5102, 5104, 5106, 5108, 5110, 5112 are all idler rollers, and are referred to herein as the front roller, second front roller, third front roller, third last or third rear roller, second last or second rear roller and the last or rear roller. The opposite ends of the longitudinally-extending rollers 5102, 5104, 5106, 5108, 5110, 5112 are rotatably coupled to a pair of longitudinally spaced-apart, laterally-extending end rails 5114, 5116. As shown in FIGS. 23–25, flanged radial bearings 5120, 5160, 5170 coupled to the end rails 5114, 5116 rotatably support the longitudinally-extending rollers 5102, 5104, 5106, 5108, 5110, 5112. The front roller 5102 is preferably made smaller than the rest of the rollers 5104, 5106, 5108, 5110, 5112 to facilitate lifting of the patient onto the upper conveyor assembly 522 as the patient transfer apparatus 520 is driven under the patient. Illustratively, the upper end rails 5114, 5116 are made from aluminum. The upper end rails 5114, 5116 are each 0.75 inches tall (1.91 centimeters) and about 0.375 inches wide (0.95 centimeters). Although flanged radial bearings 5120, 5160, 5170 are used for rotatably supporting the rollers 5102, 5104, 5106, 5108, 5110, 5112 in the embodiment described, it is within the scope of the invention as presently perceived to use any suitable means, such as ball bearings, roller bearings, bushings, etc.

Unlike the first embodiment 22, the upper conveyor assembly 522 does not include a platen assembly between the front and rear rollers 5102, 5112. Instead, a pair of longitudinally-extending spacer rods 5132, 5134 are employed to provide rigidity to the upper conveyor assembly 522. As illustrated in FIG. 24, the spacer rods 5132, 5134 are mounted inside the second front and the second last rollers 5104, 5110 respectively, and have their opposite ends secured to the end rails 5114, 5116 by flat head screws 5144, one on each side. The end rails 5114, 5116 have countersunk holes 5140 so that the outer surfaces of the flat head screws 5144 are flush with the outer surfaces of the end rails 5114, 5116. Illustratively, the flat head screws 5144 are made from stainless steel. The front and rear spacer rods 5132, 5134 are both made from aluminum, and have a diameter of 0.3125 inches (0.79 centimeters).

FIG. 23 shows the attachment of the front roller 5102 to the end rail 5114 near the head end 514. The attachment of the front roller 5102 to the other end rail 5116 near the foot end 516 is similar. The outer ring of the flanged radial bearing 5120 is formed to include a seat 5122 for fixedly receiving an end portion of the front roller 5102 as shown. The inner ring of the radial bearing 5120 is fixedly secured to the inside wall of the end rail 5114 by means of a cap screw 5124. The inside wall of the end rail 5114 includes a tapped blind hole 5126 into which the threaded portion of the cap screw 5124 is threaded. Illustratively, the upper front roller 5102 is made from thin walled stainless steel tubing about 0.0625 inches in thickness (0.16 centimeters) and about 0.625 inches in diameter (1.59 centimeters). The cap screw 5124 is made from stainless steel, is 0.25 inches in diameter (0.635 centimeters), and has 20 threads per inch (2.54 centimeters). The flanged radial bearing 5120 is marketed by NMB Bearing Corporation, Model No. SSRIF814HA1.

FIG. 24 shows the attachment of the second front roller 5104 and the enclosed spacer rod 5132 to the end rail 5114 near the head end 514. The attachment of the second front roller 5104 and the enclosed spacer rod 5132 to the other end rail 5116 near the foot end 516 is similar. The end rail 5114 has a countersunk through hole 5140, and the spacer rod 5132 has a blind tapped hole 5142 for receiving a flat head screw 5144. The flat head screw 5144 is passed through the opening 5140 in the end rail 5114, and screwed into the blind tapped hole 5142 in the spacer rod 5132 to firmly secure the spacer rod 5132 to the end rail 5114. The countersunk through hole 5140 allows the outer surface of the flat head screw 5144 to be flush with the outer surface of the end rail 5114. A flanged radial bearing 5160 is slid over the spacer rod 5132. The inner ring of the radial bearing 5160 is fixed to the spacer rod 5132. The outer ring of the radial bearing 5160 is formed to include a seat 5162 for fixedly receiving an end portion of the second front roller 5104. The second last roller 5110 and the enclosed spacer rod 5134 are attached to the end rails 5114, 5116 in similar fashion. Illustratively, the rollers 5104, 5110 are made from thin walled aluminum tubing about 0.0625 inches in thickness (0.16 centimeters), and about 1 inch in diameter (2.54 centimeters). The flat head screw 5144 is made from stainless steel, is 0.19 inches in diameter (0.48 centimeters), and has 24 threads per inch (2.54 centimeters). The front and rear spacer rods 5132, 5134 are both made from aluminum, and have a diameter of 0.3125 inches (0.79 centimeters). The flanged radial bearing 5160 is marketed by General Bearing Corporation, Model No. 31623-01.

FIG. 25 shows the attachment of the third front roller 5106 to the end rail 5114 near the head end 514. The attachment of the third front roller 5106 to the other end rail 5116 near the foot end 516 is similar. The outer ring of the flanged radial bearing 5170 is formed to include a seat 5172 for fixedly receiving an end portion of the third front roller 5106 as shown. The inner ring of the radial bearing 5170 is fixedly secured to the inside wall of the end rail 5114 by means of a cap screw 5174. The inside wall of the end rail 5114 includes a tapped blind hole 5176 into which the threaded portion of the cap screw 5174 is threaded. The third last roller 5108 and the last roller 5112 are attached to the upper end rails 5114, 5116 in similar fashion. Illustratively, the rollers 5106, 5108, 5112 are all made from thin walled aluminum tubing about 0.0625 inches in thickness (0.16 centimeters) and about 1 inch in diameter (2.54 centimeters). The cap screw 5174 is made from stainless steel, is 0.25 inches in diameter (0.635 centimeters), and has 20 threads per inch (2.54 centimeters). An endless upper conveyor web 5150 is trained about the plurality of upper rollers 5102, 5104,5106,5108,5110,5112 to provide an upper run or flight 5150' and a lower run or flight 5150' as shown in FIGS. 19–22. The flanged radial bearing 5170 is marketed by General Bearing Corporation, Model No. 31622-01.

The lower conveyor assembly 524 includes a longitudinally-extending front roller 5202, a laterally spaced-apart, longitudinally-extending rear drive roller 5212, and a set of four longitudinally-extending intermediate rollers 5204, 5206, 5208, 5210 located between the front and rear rollers 5202, 5212. The rollers 5202, 5204, 5206, 5208, 5210, 5212 are referred to herein as the front roller, second front roller, third front roller, third last or third rear roller, second last or second rear roller and the last or rear roller 5212. All the rollers are all idler rollers with the exception of the last roller 5212, which is a drive roller. A drive shaft 530 secured to the rear drive roller 5212 near foot end 516 is configured to be coupled to the actuator 5300 for driving the patient transfer apparatus 520. The rear drive roller 5212 is made larger than the rest of the rollers 5202, 5204, 5206, 5208, 5210 to increase the traction between the drive roller 5212 and the lower conveyor web 5250. The opposite ends of the longitudinally-extending rollers 5202, 5204, 5206, 5208, 5210, 5212 are rotatably coupled to a pair of longitudinally spaced-apart, laterally-extending end rails 5214, 5216. Flanged radial bearings 5260, 5270, 5280 coupled to the end rails 5214, 5216 rotatably support the longitudinally-extending rollers 5202, 5204, 5206, 5208, 5210, 5212, with one exception. A needle bearing 5290 is used to support the foot end 516 of the rear drive roller 5212 coupled to the drive shaft 530. Illustratively, the end rails 5214, 5216 are made from aluminum. The end rails 5214, 5216 are each about 1.375 inches tall in the back (3.49 centimeters), about 0.625 inches tall in the front (1.59 centimeters), and about 0.375 inches wide (0.95 centimeters). Although flanged radial bearings 5260, 5270, 5280 are used for rotatably supporting the rollers 5202, 5204, 5206, 5208, 5210, 5212, it is within the scope of the invention as presently perceived to use any suitable means, such as ball bearings, roller bearings, bushings, etc.

Unlike the first embodiment 24, the lower conveyor assembly 524 does not include a platen assembly between the front and rear rollers 5202, 5212. Instead, a pair of longitudinally-extending spacer rods 5232, 5234 are employed in the third embodiment 520 to provide rigidity to the lower conveyor assembly 524 as shown in FIGS. 18–22. As described below, the spacer rods 5232, 5234 are mounted inside the second front and the second last rollers 5204, 5210 respectively, and have their opposite ends secured to the end rails 5214, 5216 by flat head screws 5244. The end rails 5214, 5216 have countersunk holes 5240 so that the outer surfaces of the flat head screws 5244 are flush with the outer surfaces of the end rails 5214, 5216 in the manner shown in FIG. 24. Illustratively, the flat head screws 5244 are made from stainless steel. The spacer rods 5232, 5234 are both made from aluminum. The spacer rods 5232, 5234 have a diameter of 0.3125 inches (0.79 centimeters). Illustratively, the rear drive roller 5212 is made from thin walled aluminum tubing about 0.0625 inches in thickness (0.16 centimeters), and about 1.75 inches in diameter (4.45 centimeters). The remaining rollers 5202, 5204, 5106, 5108, 5110 are all made from thin walled aluminum tubing about 0.0625 inches in thickness (0.16 centimeters), and about 1 inch in diameter (2.54 centimeters). As previously indicated, the rear drive roller 5212 is made larger than the rest of the rollers 5202, 5204, 5206, 5208, 5210 to increase the traction between the drive roller 5212 and the lower conveyor web 5250.

The lower rollers 5202, 5206, 5208 are rotatably coupled to the lower end rails 5214, 5216 by the flanged radial bearings 5270 in the same way the upper rollers 5106, 5108 5112 are rotatably coupled to the upper end rails 5114, 5116 by the flanged radial bearings 5170 as shown in FIG. 25. The lower rollers 5204, 5210 and the enclosed spacer rods 5232, 5234 are rotatably coupled to the lower end rails 5214, 5216 by the flanged radial bearings 5260 in the same way the upper rollers 5104, 5110 and the enclosed spacer rods 5132, 5134 are rotatably coupled to the upper end rails 5114, 5116 by the flanged radial bearings 5160 as shown in FIG. 24.

Figure 26:
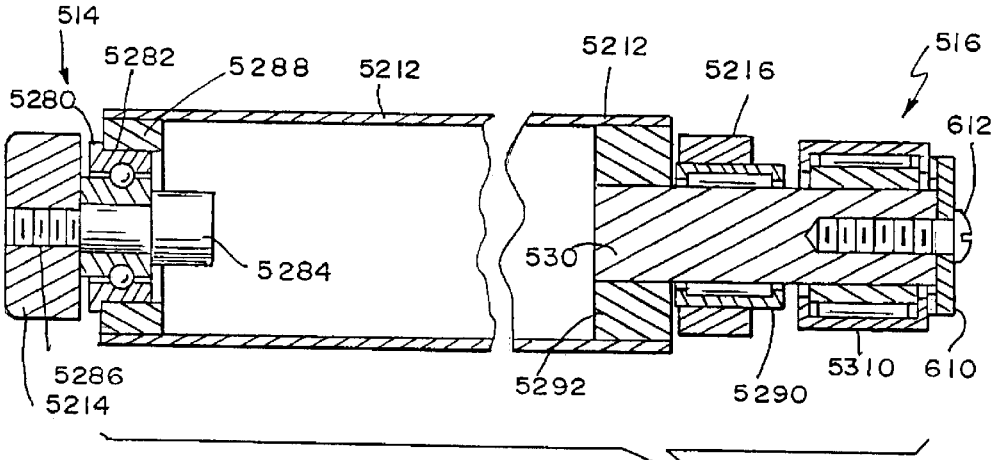

FIG. 26 shows the attachment of the rear drive roller 5212 to the end rails 5214, 5216. The head end 514 of the rear drive roller 5212 is rotatably coupled to the end rail 5214 by a flanged radial bearing 5280 in the same way the upper rollers 5106, 5108 5112 are rotatably coupled to the upper end rails 5114, 5116 by the flanged radial bearings 5170 as indicated in FIG. 25. The outer ring of the flanged radial bearing 5280 is formed to include a seat 5282 for fixedly receiving a spacer sleeve 5288 attached to an end portion of the roller 5212 as shown. The inner ring of the radial bearing 5280 is fixedly secured to the inside wall of the end rail 5214 by means of a cap screw 5284. The inside wall of the end rail 5214 includes a tapped blind hole 5286 into which the threaded portion of the cap screw 5284 is screwed. Illustratively, the cap screw 5284 is made from stainless steel, is 0.375 inches in diameter (0.953 centimeters), and has 16 threads per inch (2.54 centimeters). The flanged radial bearing 5280 is marketed by General Bearing Corporation, Model No. 31861-00.

The foot end 516 of the rear drive roller 5212 is coupled to the drive shaft 530 by means of a spacer sleeve 5292 as shown in FIG. 26. The drive shaft 530 is rotatably coupled to the end rail 5216 by a needle bearing 5290. The outer ring of the needle bearing 5290 is fixedly secured to the end rail 5216 as shown in FIG. 26. The inner ring of the needle bearing 5290 is fixedly secured to the drive shaft 530. Illustratively, the needle bearing 5290 is marketed by INA Bearing Corporation, Model No. HK2018RS.

Figure 19:
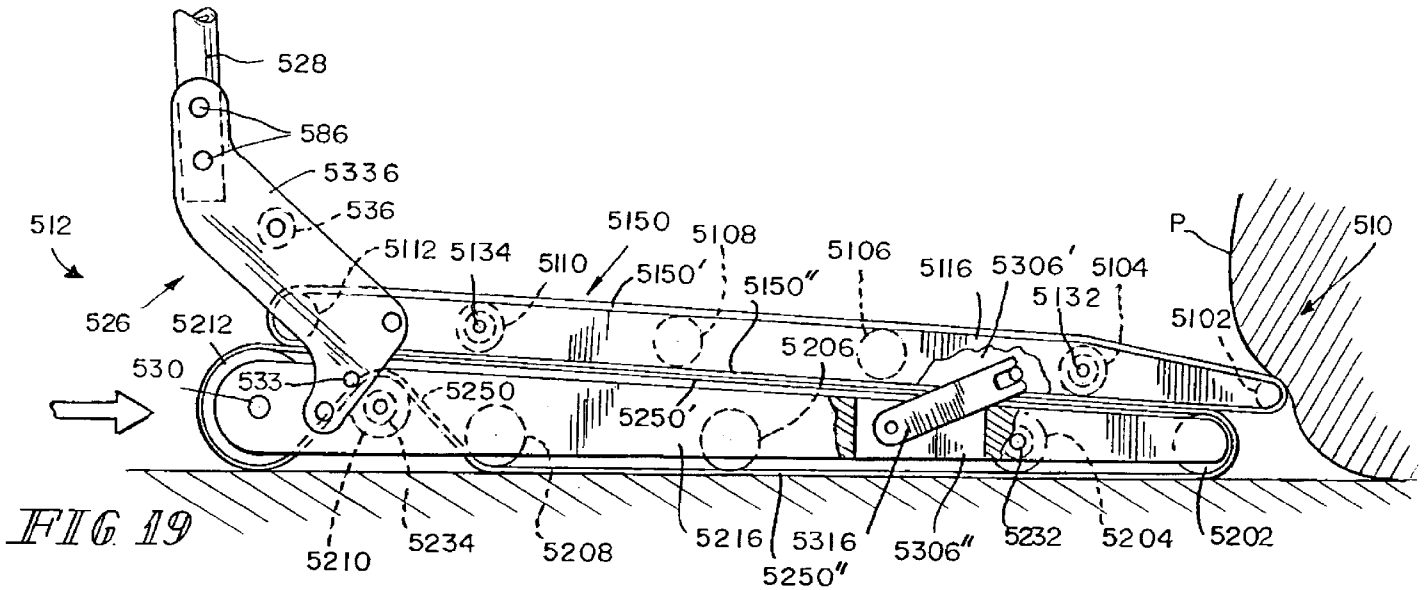
FIG. 19 is an end view of the patient transfer apparatus of FIG. 18 similar to FIG. 6, and showing the lift handle moved to a forward position to move the upper conveyor assembly to the lowered engaged position to cause the lower flight of the upper conveyor web to engage the upper flight of the lower drive conveyor web, the upper conveyor web being movable about the upper rollers to provide a movable support for patient, the lower drive conveyor web being movable about the lower rollers to move the apparatus relative to the first and second supports, the upper conveyor assembly being shown located forwardly and downwardly and closer to the front edge of the patient transfer apparatus.
Figure 20:
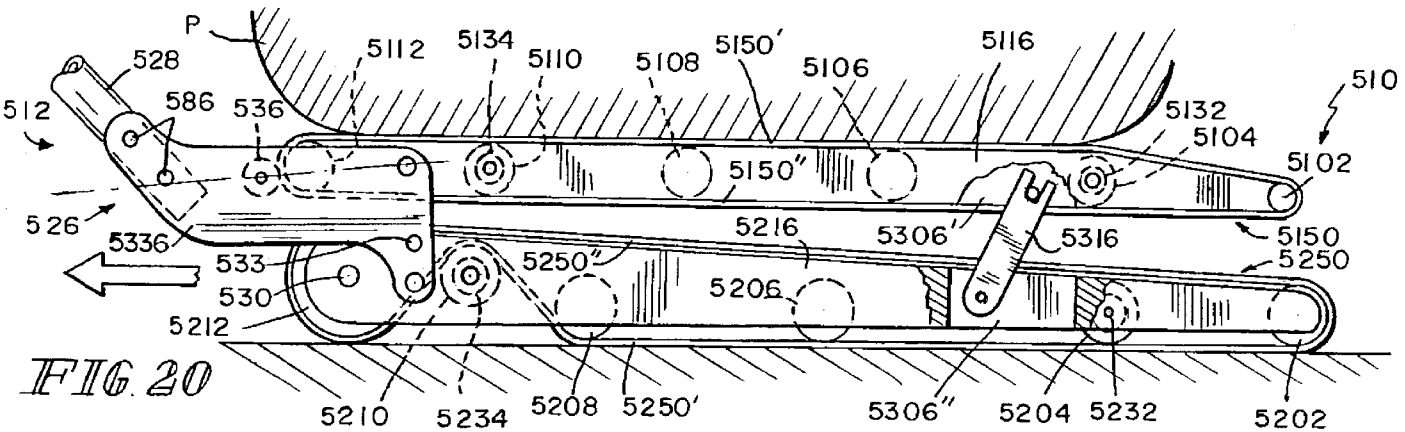
FIG. 20 is an end view similar to FIG. 19, and showing the lift handle moved to a retracted position to lift the upper conveyor assembly to the raised disengaged position to disengage the lower flight of the upper conveyor web from the upper flight of the lower drive conveyor web, and showing the upper conveyor assembly located rearwardly and upwardly from the lower conveyor assembly and resting against a stop bar, and further showing the brake pads pressed against the upper conveyor web to lock it in place.
Figure 21:
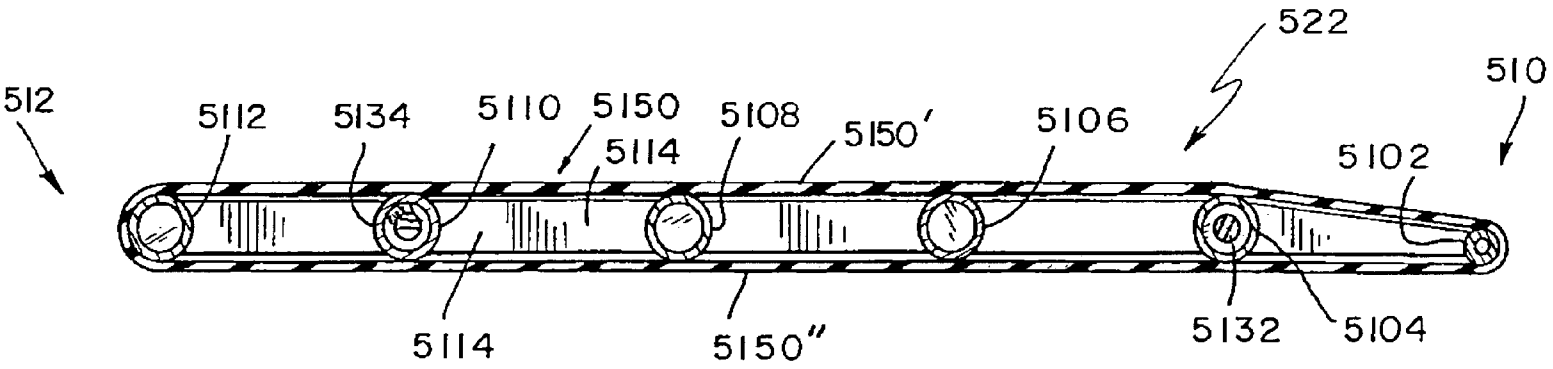
FIG. 21 is a sectional end view of the upper conveyor assembly showing an end rail adjacent to the head end of the patient transfer apparatus, a plurality of laterally spaced-apart elongated rollers, a pair of laterally spaced-apart elongated spacer bars mounted inside the second front and second last rollers, and an endless conveyor web trained about the plurality of rollers to provide an upper flight and a lower flight.
Figure 22:
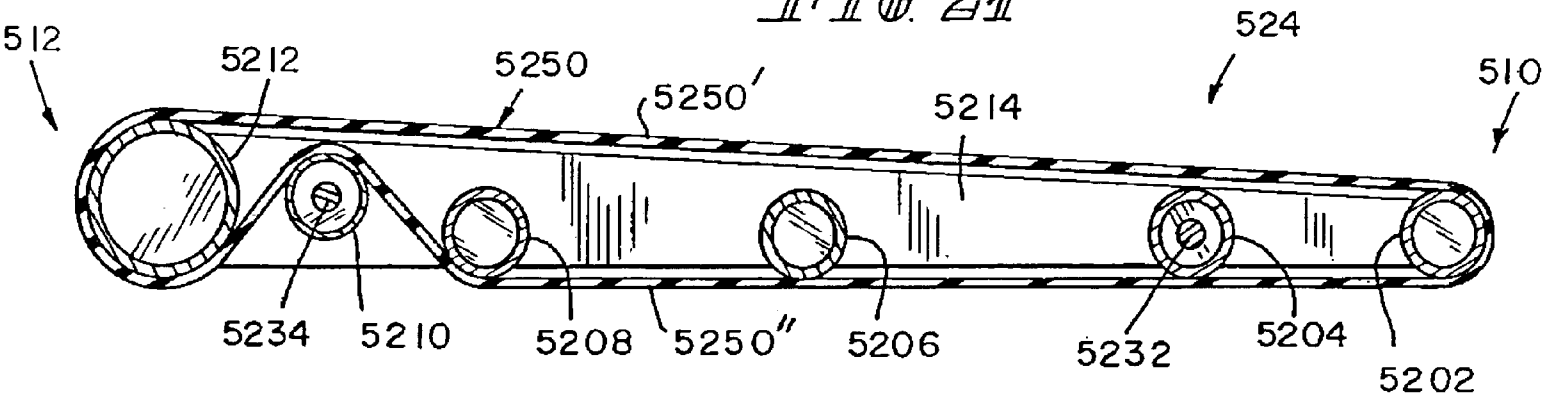
FIG. 22 is a sectional end view similar to FIG. 21 of the lower conveyor assembly, and showing an end rail adjacent to the head end of the patient transfer apparatus, a plurality of laterally spaced-apart elongated rollers, a pair of laterally spaced-apart elongated spacer bars mounted inside the second front and second last rollers, and an endless conveyor web trained about the plurality of rollers to provide an upper flight and a lower flight, and further showing the lower conveyor web looped around the second last roller located next to the rear drive roller to increase the wrap of the lower conveyor web around the rear drive roller.

An endless lower drive conveyor web 5250 is trained about the plurality of lower rollers 5202, 5204, 5206, 5208, 5210, 5212 to provide an upper run or flight 5250' and a lower run or flight 5250". As shown in FIGS. 19, 20 and 22, the lower conveyor web 5250 is looped around the second last roller 5210 adjacent to the rear drive roller 5212 to increase the wrap of the lower conveyor web 5250 about the rear drive roller 5212 so that the lower conveyor web 5250 does not slip as the rear drive roller 5212 is turned by the actuator 5300. Illustratively, the rollers 5202, 5204, 5206, 5108, 5210, 5212 are all made from thin walled aluminum tubing about 0.0625 inches (0.16 centimeters) in thickness. The rear drive roller 5212 is about 1.75 inches (4.45 centimeters) in diameter, and the rest of the rollers 5202, 5204, 5206, 5208 and 5210 are about 1 inch in diameter (2.5 centimeters).

Figure 27:
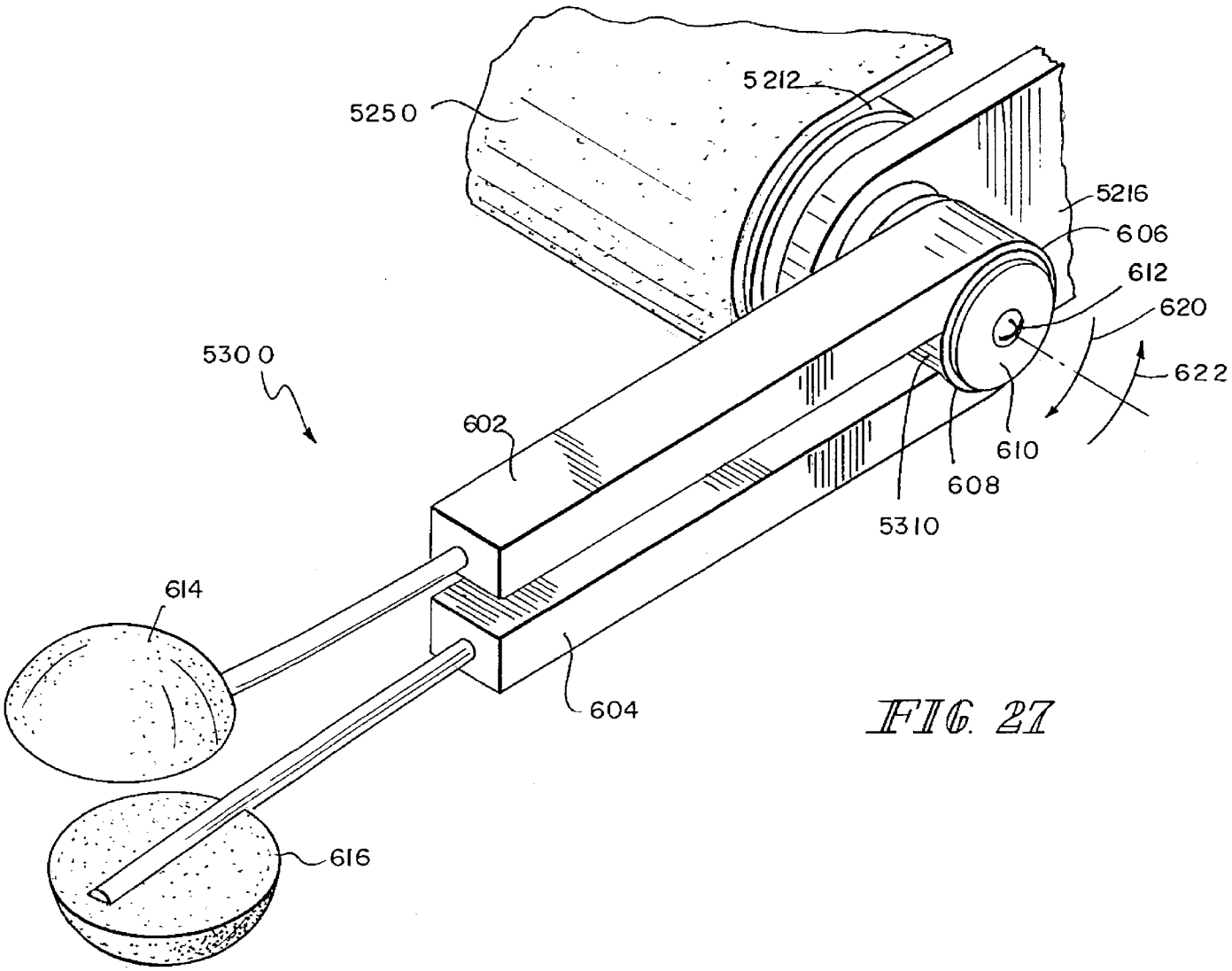
FIG. 27 is a perspective view showing the actuator coupled to the roller clutch mounted on the drive shaft for driving the rear drive roller of the lower conveyor assembly.

The drive shaft 530 coupled to the rear drive roller 5212 extends through the end rail 5216 adjacent to the foot end 516 as shown in FIGS. 26 and 27. The actuator 5300 is configured to be coupled to the drive shaft 530 to rotate the drive roller 5212. Rotation of the drive roller 5212 is, in turn, transmitted to the lower conveyor web 5250. The actuator 5300 includes first and second elongated arm portions 602, 604 and an intermediate portion 606 in the form of a split collar. The split collar 606 includes a central opening 608 for receiving a roller clutch 5310 similar to the roller clutch 4310 used in the second embodiment 420 shown in FIG. 17. The roller clutch 5310 is mounted on the drive shaft 530 to transmit rotation of the actuator 5300 only in clockwise locking direction 620. Rotation of the actuator 5300 in anticlockwise overrunning direction 622, however, is not transmitted to the drive shaft 530. The inner ring of the roller clutch 5310 is fixedly secured to the drive shaft 530. The outer ring of the roller clutch 5310 received in the central opening 608 of the split collar 606 is releasably securable to the actuator 5300. The actuator 5300 and the roller clutch 5310 are held in place on the drive shaft 530 by a large diameter washer 610 secured to the free end of the drive shaft 530 by a screw 612.

The actuator 5300 includes a pair of handles 614, 616 coupled to the respective elongated arm portions 602 and 604. When the handles 614 and 616 are squeezed together, the two halves of the split collar 606 are pulled together to, in turn, lock the actuator 5300 to the outer ring of the roller clutch 5310. When the handles 614 and 616 are released, the two halves of the split collar 606 are again separated to free the outer ring of the roller clutch 5310. Suitable releasable fastening means—such as a hook and loop device (for example, a fastener sold under the trademark "Velcro") or a clip (not shown) may be used to attach the actuator 5300 to a frame member, such as the lift handle 528 or the end rail 5216 to prevent the actuator 5300 from flopping around when not in use. Illustratively, the roller clutch 5310 is marketed by NA Bearing Corporation, Model No. HF2016.

Figure 18:
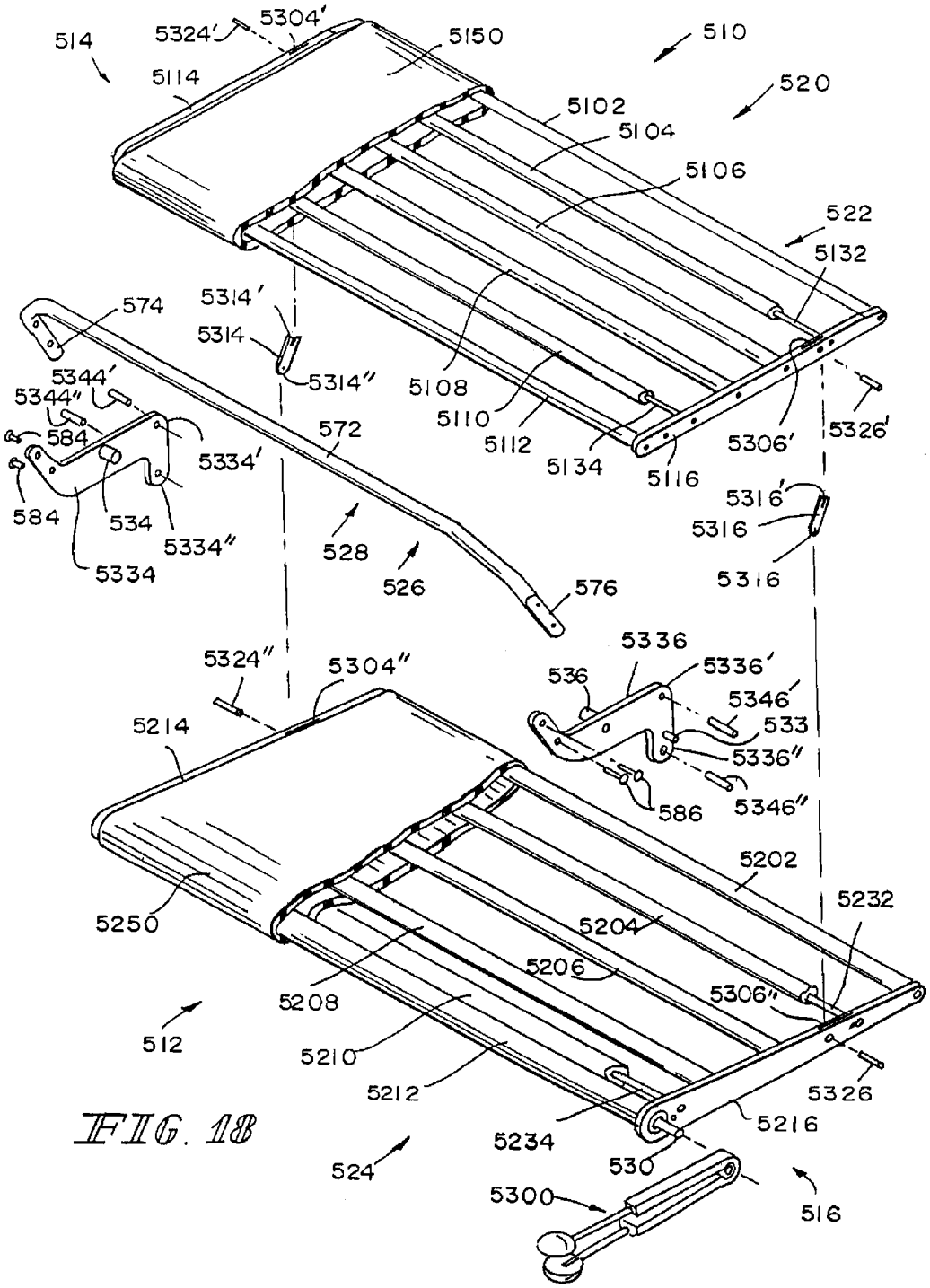
FIG. 18 is a partially broken away and partially exploded perspective view of a third embodiment of the patient transfer apparatus similar to the first and second embodiments shown in FIGS. 1–15 and 16–17 respectively, the FIG. 18 patient transfer apparatus including an upper conveyor assembly, a lower conveyor assembly, a four-bar linkage movably connecting the upper conveyor assembly to the lower conveyor assembly, a lift handle coupled to the four-bar linkage for moving the upper conveyor assembly between a raised disengaged position when the lift handle is moved to a retracted position and a lowered engaged position when the lift handle is moved to a forward position, an actuator configured to be coupled to the lower conveyor assembly to drive the lower conveyor assembly and a pair of brake pads coupled to the lift handle and configured to engage the upper conveyor assembly when the lift handle is moved to the retracted position, the upper and lower conveyor assemblies each including a pair of longitudinally spaced-apart, laterally-extending end rails, a plurality of laterally spaced-apart elongated rollers extending between the end rails, a pair of laterally spaced-apart elongated spacer rods extending between the end rails and positioned inside the second front and the second last rollers, and an endless conveyor web trained about the plurality of rollers to provide an upper flight and a lower flight, the brake pads being configured to engage the upper conveyor web when the lift handle is retracted to lock the upper conveyor web in place.

Referring to FIG. 18, the four-bar linkage 526 movably connects the upper conveyor assembly 522 to the lower conveyor assembly 524. The lift handle 528 is coupled to the four-bar linkage 526 for moving the upper conveyor assembly 522 between a lowered engaged position shown in FIG. 19 when the lift handle 528 is moved to the forward position, and a raised disengaged position shown in FIG. 20 when the lift handle is moved to the retracted position. The four bar linkage 526 includes a pair of swing arms or links 5314, 5316 adjacent to the front side 510 of the patient transfer apparatus 520. The links 5314, 5316 have their respective upper and lower ends 5314', 5314" and 5316', 5316" pivotally coupled to the upper and lower conveyor assemblies 522, 524.

Figure 28:
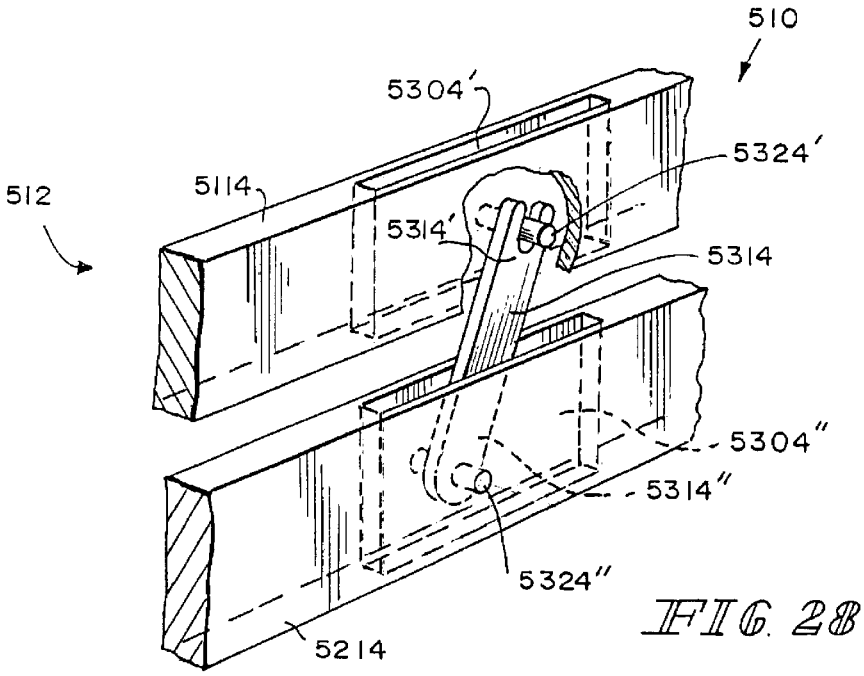
FIG. 28 is a partially broken away perspective view showing the upper and lower end rails adjacent to the head end of the patient transfer apparatus and a link having its ends pivotally coupled to the upper and lower end rails near the front side thereof, and further showing the upper and lower end rails having cutouts forming a protective enclosure for the link.

The upper end 5314' of the first link 5314 is pivotally coupled to the upper end rail 5114 adjacent to the front side 510 near the head end 514 by a pivot pin 5324' as shown in FIGS. 18, 28. The upper end 5314' of the first link 5314 is configured to form an open-ended slot for receiving the pivot pin 5324'. The open-ended construction of the slot facilitates assembly of the upper conveyor assembly 522 with the lower conveyor assembly 524. The open-ended construction of the slot also permits removal of the upper conveyor web 5150 from the upper conveyor rollers 5102–5112 for cleaning, repair, or replacement. The lower end 5314" of the first link 5314 is pivotally coupled to the lower end rail 5214 adjacent to the front side 510 near the head end 514 by a pivot pin 5324".

Likewise, the upper end 5316' of the second link 5316 is pivotally coupled to the upper end rail 5116 adjacent to the front side 510 near the foot end 516 by a pivot pin 5326'. The upper end 5316' of the second link 5316 is configured to form an open-ended slot for receiving the pivot pin 5326'. As previously described, the open-ended construction of the slot simplifies assembly of the upper conveyor assembly 522 with the lower conveyor assembly 524. The open-ended construction of the slot also permits removal of the upper conveyor web 5150 from the upper conveyor rollers 5102–5112 for cleaning, repair, or replacement. The lower end 5316" of the second link 5316 is pivotally coupled to the lower end rail 5216 adjacent to the front side 510 near the foot end 516 by a pivot pin 5326".

The link 5314 is mounted in cutouts 5304', 5304" provided in the upper and lower end rails 5114 and 5214 adjacent to the front side 510 near the head end 514. Likewise, the link 5316 is mounted in cutouts 5306', 5306" provided in the upper and lower end rails 5116 and 5216 adjacent to the front side 510 near the foot end 516. The cutouts 5304', 5304" in the upper and lower end rails 5114, 5214 adjacent to the head end 514 and the cutouts 5306', 5306" in the upper and lower end rails 5116, 5216 adjacent to the foot end 516 are sufficiently wide to accommodate swinging motion of the first and second links 5314, 5316 in response to movement of the lift handle 528 between the forward and retracted positions shown in FIGS. 19, 20. Enclosure of links 5314, 5316 in the respective cutouts 5304', 5304" and 5306', 5306" provide a degree of protection to the caregiver and the patient from accidental injury. The cutouts 5304', 5304" in the upper and lower end rails 5114, 5214 adjacent to the head end 514 and the cutouts 5306', 5306" in the upper and lower end rails 5116, 5216 adjacent to the foot end 516 may be either through openings extending between the top and bottom walls of the end rails 5114, 5116 and 5214, 5216 as shown or, in the alternative, blind holes in communication with the bottom walls of the top end rails 5114, 5116 and in communication with the top walls of the bottom end rails 5214, 5216. Illustratively, the links 5314, 5316 are both made from stainless steel, about 2.25 inches in length (5.72 centimeters), and about 0.125 inches in thickness (0.32 centimeters). The spacing between the pivot pins 5324', 5324" and 5326', 5326" is about 1.60 inches (4.07 centimeters). The cutouts 5304', 5304" and 5306', 5306" are each 2 inches long (5.08 centimeters), and 0.25 inches wide (0.635 centimeters).

The four bar linkage 526 further includes a pair of lift handle brackets 5334, 5336 adjacent to the rear side 512 of the patient transfer apparatus 520 as shown in FIG. 18. The handle brackets 5334, 5336 have their respective upper and lower ends 5334', 5334" and 5336', 5336" pivotally coupled to the upper and lower conveyor assemblies 522, 524. The upper end 5334' of the first handle bracket 5334 is pivotally coupled to the upper end rail 5114 adjacent to the head end 514 near the rear side 512 by a pivot pin 5344'. The lower end 5334" of the first handle bracket 5334 is pivotally coupled to the lower end rail 5214 adjacent to the head end 514 near the rear side 512 by a pivot pin 5344". Likewise, the upper end 5336' of the second handle bracket 5336 is pivotally coupled to the upper end rail 5116 adjacent to the foot end 516 near the rear side 512 by a pivot pin 5346'. The lower end 5336" of the second handle bracket 5336 is pivotally coupled to the lower end rail 5216 adjacent to the foot end 516 near the rear side 512 by a pivot pin 5346". As shown in FIGS. 18–20, the handle brackets 5334, 5336 are mounted on the outside of the upper and lower end rails 5114, 5214 and 5116, 5216 adjacent to the rear side 512 of the patient transfer apparatus 520. Illustratively, the handle brackets 5334, 5336 are both made from aluminum, and about 0.25 inches thick (0.635 centimeters). The spacing between the pivot pins 5344', 5344" and 5346', 5346" is about 1.60 inches (4.07 centimeters).

The lift handle 528 includes a middle portion 572 and end portions 574, 576 as shown in FIG. 18. The end portions 574, 576 of the lift handle 528 are secured to the respective handle brackets 5334, 5336 by means of flat head screws 584, 586. The handle brackets 5334, 5336 are provided with countersunk holes 594, 596 so that the outer surfaces of the screws 584, 586 are flush with the outer surfaces of the handle brackets 5334, 5336.

The brake pads 534 and 536 in the form of rubber brake sleeves are secured to the handle brackets 5334 and 5336 adjacent to the head end 514 and foot end 516 respectively. As shown in FIGS. 29–31, the brake pad 534 includes a post 544 secured to the inner wall of the handle bracket 5334 near the head end 514 by a flat head screw 554. The handle bracket 5334 is provided with a countersunk hole 564 so that the outer surface of the screw 554 is flush with the outer surface of the handle bracket 5334. Likewise, the second brake pad 536 includes a post 546 secured to the inner wall of the handle bracket 5336 near the foot end 516 by a flat head screw 556. The brake pads 534 and 536 are spaced apart from the upper conveyor web 5150 when the lift handle 528 is moved to the forward position as shown in FIG. 29. On the other hand, the brake pads 534 and 536 are pressed against the upper conveyor web 5150 as shown in FIG. 30 to prevent inadvertent rolling of the upper conveyor web 5150 during transfer of the patient from one surface to another.

Figure 32:
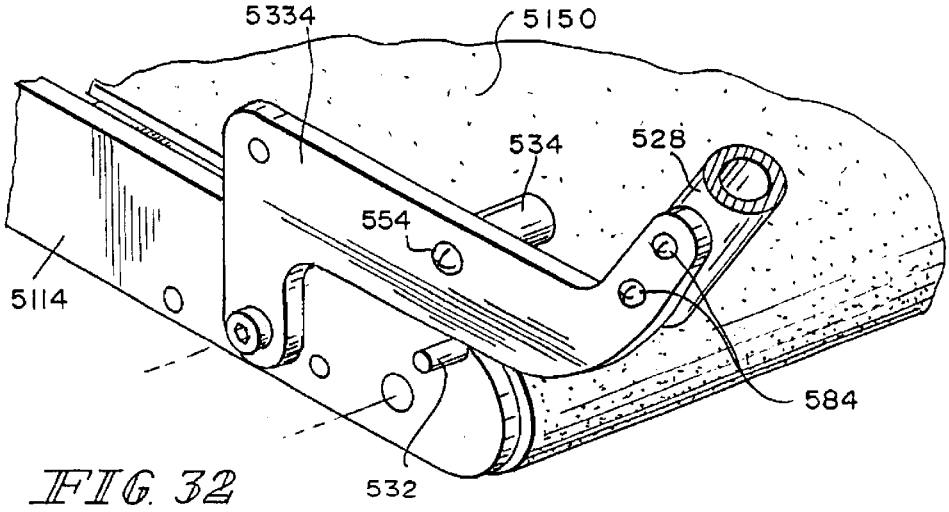
FIG. 32 is a perspective view showing the upper conveyor web trained about the upper rear roller, and the lift handle moved to the retracted position and resting against a stop pin coupled to the upper end rail near the head end and adjacent to the rear side of the patient transfer apparatus.

When the lift handle 528 is moved to the forward position, the upper conveyor assembly 522 is lowered to engage the lower conveyor assembly 524, and located forwardly therefrom closer to the front side 510 of the patient transfer apparatus 20 as shown in FIG. 19. On the other hand, the four-bar linkage 526 is configured such that the upper conveyor assembly 522 is spaced upwardly from the lower conveyor assembly 524, and located rearwardly therefrom, when the lift handle 528 is moved to the retracted position as shown in FIG. 20. The handle bracket 5334 rests against a stop pin 532 coupled to the upper end rail 5114 adjacent to the head end 514 near the rear side 512 of the patient transfer apparatus 520 when the lift handle 528 is moved to the retracted position as shown in FIG. 32. Detachable pinch prevention guards (not shown) may be coupled to the upper end rails 5114, 5116 to cover the gaps between the upper and lower end rails 5114, 5214 and 5116, 5216.

The operation of the patient transfer device 520 will now be explained. with reference to FIGS. 1–4. To transfer a patient from a first support 21, such as a stretcher, to a second support 23, such as a hospital bed, the first support 21 with the patient resting thereon is positioned next to the second support 23 to which the patient is to be transferred. The patient transfer device 520 is placed on the second support 23 between the head and foot ends thereof alongside the patient on the first support 21 as shown in FIG. 1, and the lift handle 528 is pushed forward to lower the upper conveyor assembly 522 onto the lower conveyor assembly 524 to, in turn, engage the upper patient conveyor 5150 with the lower drive conveyor 5250. The handles 614, 616 of the actuator 5300 are squeezed together to lock the actuator 5300 to the roller clutch 5310. The actuator 5300 is then moved forward (i.e., toward the patient) and backward (i.e., away from the patient) to turn the lower drive conveyor 5250 to, in turn, move the patient transfer apparatus 520 toward the patient on the first support 21, and to move the patient onto the upper conveyor assembly 522. The material of the upper conveyor web 5150 is sufficiently thick to prevent "hammocking" of the upper conveyor web 5150 between the upper conveyor rollers 5102–5112.

The inner wall of the lower arm portion 604 of the actuator 5300 includes a pin (not shown) that is configured to engage a stop 533 on the outer wall of the handle bracket 5336 near the foot end 516 of the patient transfer apparatus 520 during clockwise rotation of the actuator 5300 in the direction 620 in FIG. 27. Thus, the stop 533 prevents the actuator 5300 from moving downwardly into contact with the patient supports 21 and 23.

To move the patient to the second support 23, the lift handle 528 is retracted as shown in FIG. 3 to lift the upper conveyor assembly 522 above the lower conveyor assembly 524, to disengage the upper conveyor assembly 522 from the lower conveyor assembly 524, and to press the brake pads 534, 536 against the upper conveyor web 5150 to lock it in place. The handles 614 and 616 are then released to loosen the split collar 606 to, in turn, free the roller clutch 5310. The lift handle 528 is then used to roll the patient transfer apparatus 520 with the patient resting thereon onto the second support 23. The use of bearings 5260, 5270, 5280 and 5290 facilitate rotation of the bottom rollers 5202–5212 when the patient transfer apparatus 520 is rolled to the second support 23.

To deposit the patient onto the second support 23 and remove the patient transfer apparatus 520 from under the patient, the lift handle 528 is pushed forward. The lift handle 528 is then used to tilt the patient transfer apparatus 520 forward to allow the patient to gently slide onto the second support 23.

Although the invention has been described in detail, variations and modifications exist within the scope and spirit of the invention as described and defined in the following claims.

What is claimed is:

1. A patient transfer apparatus for moving a patient from a first support to a second support, the apparatus having a front side, a rear side, a head end and a foot end, the apparatus being configured to be placed on the second support between the head and foot ends thereof to be positioned alongside the patient on the first support, the apparatus comprising:

an upper conveyor assembly, a lower conveyor assembly, an adjustment mechanism for raising and lowering the upper conveyor assembly relative to the lower conveyor assembly, wherein the adjustment mechanism includes a lift handle movable to a first position to raise the upper conveyor assembly relative to the lower conveyor assembly and movable to a second position to lower the upper conveyor assembly relative to the lower conveyor assembly, each conveyor assembly comprising laterally spaced-apart, longitudinally extending side members and an endless conveyor web trained about the side members, wherein the upper conveyor web engages the lower conveyor web to couple the motion of the lower conveyor web to the upper conveyor web when the upper conveyor assembly is lowered, wherein the upper conveyor web disengages from the lower conveyor web for transport of a patient positioned on the upper conveyor web when the upper conveyor assembly is raised, and wherein the adjustment mechanism is configured to raise and lower the upper conveyor assembly relative to the lower conveyor assembly while the upper and lower conveyor webs are stationary, and a driver operatively coupled to drive the lower conveyor web, wherein, when the upper conveyor assembly is lowered, the driver is operable to drive the upper and lower conveyor webs to cause the apparatus to move under a patient lying on the first supports and wherein, when the upper conveyor assembly is raised, movement of the lower conveyor web causes the patient atop the upper conveyor web to move to the second support by an action between the lower conveyor web and the two supports.

2. The apparatus of claim 1, wherein each conveyor assembly comprises a pair of longitudinally spaced-apart, laterally-extending end rails adjacent to the head and foot ends of the apparatus respectively, a pair of laterally spaced-apart, longitudinally-extending front and rear rollers extending between the end rails, and an endless conveyor web trained about the front and rear rollers.

3. The apparatus of claim 2, wherein the adjustment mechanism comprises a pair of links adjacent to the front side of the apparatus and a pair of handle brackets adjacent to the rear side of the apparatus, wherein the links have their respective ends pivotally coupled to the upper and lower end rails adjacent to the front side of the apparatus, and wherein the handle brackets have their respective ends pivotally coupled to the upper and lower end rails adjacent to the rear side of the apparatus.

4. The apparatus of claim 3, comprising a lift handle coupled to the handle brackets for moving the upper conveyor assembly between a lowered engaged position where the upper conveyor web engages the lower conveyor web to couple the motion of the lower conveyor web to the upper conveyor web and a raised disengaged position where the upper conveyor web is spaced apart from the lower conveyor web.

5. The apparatus of claim 2, wherein the rear roller of the lower conveyor assembly is configured to be coupled to the driver for driving the lower conveyor web, and wherein the driver comprises a roller clutch-type actuator.

6. The apparatus of claim 2, wherein each conveyor assembly comprises bearings coupled to the end rails for rotatably supporting the longitudinally-extending front and rear rollers.

7. The apparatus of claim 2, wherein each conveyor assembly comprises a support structure coupled to the end rails and extending between the longitudinally-extending front and rear rollers.

8. The apparatus of claim 7, wherein the support structure comprises a generally rectangular panel and a pair of longitudinally-extending members secured to the opposite sides of the panel.

9. The apparatus of claim 7, wherein the support structure comprises a generally rectangular panel and a pair of laterally-extending members secured to the opposite ends of the panel.

10. The apparatus of claim 2, comprising a front idler roller assembly coupled to the lower end rails adjacent to the front side of the apparatus to facilitate movement of the patient onto the upper conveyor assembly by the upper conveyor web as the apparatus is moved from the second support to the first support by the lower conveyor web.

11. The apparatus of claim 1, wherein the adjustment mechanism comprises a pair of links adjacent to the front side of the apparatus and a pair of handle brackets adjacent to the rear side of the apparatus, wherein the links have their respective ends pivotally coupled to the upper and lower conveyor assemblies adjacent to the front side of the apparatus, and wherein the handle brackets have their respective ends pivotally coupled to the upper and lower conveyor assemblies adjacent to the rear side of the apparatus.

12. The apparatus of claim 1, wherein the upper conveyor assembly comprises a pair of longitudinally spaced-apart, laterally-extending end rails adjacent to the head and foot ends of the apparatus respectively, a pair of laterally spaced-apart, longitudinally-extending front and rear rollers extending between the end rails, a support structure coupled to the end rails and extending between the longitudinally-extending front and rear rollers, and the upper endless conveyor web being trained about the front and rear rollers.

13. The apparatus of claim 12, wherein the support structure comprises a generally rectangular panel and a pair of longitudinally-extending members secured to the opposite sides of the panel.

14. The apparatus of claim 12, wherein the support structure comprises a generally rectangular panel and a pair of laterally-extending members secured to the opposite ends of the panel.

15. The apparatus of claim 12, wherein the lower conveyor assembly comprises a pair of longitudinally spaced-apart, laterally-extending end rails adjacent to the head and foot ends of the apparatus respectively, a plurality of laterally spaced-apart, longitudinally-extending rollers extending between the end rails, at least one longitudinally-extending spacer rod extending between the end rails, and the lower endless conveyor web being trained about the plurality of rollers.

16. The apparatus of claim 15, wherein the plurality of rollers of the lower conveyor assembly comprise a front roller, a second front roller, a second last roller and a last roller extending between the end rails, a longitudinally-extending front spacer rod positioned between the front roller and the second front roller and extending between the end rails, and a longitudinally-extending rear spacer rod positioned between the last roller and the second last roller and extending between the end rails.

17. The apparatus of claim 15, wherein the adjustment mechanism comprises a pair of links adjacent to the front side of the apparatus and a pair of handle brackets adjacent to the rear side of the apparatus, wherein the links have their respective ends pivotally coupled to the upper and lower end rails adjacent to the front side of the apparatus, and wherein the handle brackets have their respective ends pivotally coupled to the upper and lower end rails adjacent to the rear side of the apparatus.

18. The apparatus of claim 17, comprising a lift handle coupled to the handle brackets to move the upper conveyor assembly between a lowered engaged position where the upper conveyor web engages the lower conveyor web to couple the motion of the lower conveyor web to the upper conveyor web and a raised disengaged position where the upper conveyor web is spaced apart from the lower conveyor web.

19. The apparatus of claim 15, wherein the lower conveyor assembly comprises a front roller, a rear roller and a set of intermediate rollers extending between the end rails, wherein the rear roller of the lower conveyor assembly is configured to be coupled to the driver for driving the lower conveyor web, and wherein the driver comprises a roller clutch-type actuator.

20. The apparatus of claim 1, wherein each conveyor assembly comprises a pair of longitudinally spaced-apart, laterally-extending end rails adjacent to the head and foot ends of the apparatus respectively, a plurality of laterally spaced-apart, longitudinally-extending rollers extending between the end rails, at least one longitudinally-extending spacer rod extending between the end rails, and the endless conveyor web of each assembly being trained about the plurality of rollers.

21. The apparatus of claim 20, wherein the plurality of rollers of each conveyor assembly comprise a front roller, a second front roller, a second last roller and a last roller extending between the end rails, and wherein each second front and second last rollers includes a longitudinally-extending spacer rod enclosed therein and extending between the end rails.

22. The apparatus of claim 20, wherein the adjustment mechanism comprises a pair of links adjacent to the front side of the apparatus and a pair of handle brackets adjacent to the rear side of the apparatus, wherein the links have their respective ends pivotally coupled to the upper and lower end rails adjacent to the front side of the apparatus, and wherein the handle brackets have their respective ends pivotally coupled to the upper and lower end rails adjacent to the rear side of the apparatus.

23. The apparatus of claim 22, comprising a lift handle coupled to the handle brackets to move the upper conveyor assembly between a lowered engaged position where the upper conveyor web engages the lower conveyor web to couple the motion of the lower conveyor web to the upper conveyor web and a raised disengaged position where the upper conveyor web is spaced apart from the lower conveyor web.

24. The apparatus of claim 20, wherein the lower conveyor assembly comprises a front roller, a rear roller and a set of intermediate rollers extending between the end rails, wherein the rear roller of the lower conveyor assembly is configured to be coupled to the driver for driving the lower conveyor web, and wherein the driver comprises a roller clutch-type actuator.

25. The apparatus of claim 20, wherein the lower conveyor assembly comprises a front roller, a second front roller, a second last roller and a last roller extending between the end rails, wherein the last roller is configured to be coupled to the driver for driving the lower conveyor web, and wherein the lower conveyor web is looped around the second last roller to increase the wrap of the lower conveyor web around the last roller.

26. An apparatus for transferring a patient from a first support to a second support configured to be positioned alongside the first support, the apparatus comprising:

upper and lower structures to be placed on the second support to extend alongside the patient on the first support, the upper structure comprising laterally spaced-apart, elongated upper side members and an endless conveyor web trained about the side members to provide an upper flight and a lower flight, the conveyor web being movable about the upper side members to provide a movable support for patient, the lower structure comprising laterally spaced-apart, elongated lower side members and an endless drive web trained about the lower side members to provide an upper flight and a lower flight, the drive web being movable about the lower side members to move the apparatus relative to the second support, an adjustment mechanism for raising and lowering the upper structure relative to the lower structure, the adjustment mechanism including a lift handle movable to a first position to raise the upper structure relative to the lower structure and movable to a second position to lower the upper structure relative to the lower structure, the upper conveyor web engaging the lower drive web to couple the motion of the lower drive web to the upper conveyor web when the upper structure is lowered, the upper conveyor web disengaging from the lower drive web for transport of a patient positioned on the upper conveyor web when the upper structure is raised, the adjustment mechanism being configured to raise and lower the upper structure relative to the lower structure while the upper and lower webs are stationary, and the upper conveyor web and the lower drive web being configured to be operatively connected such that movement of the lower drive web about the lower side members to move the apparatus from the second support to the first support moves the upper conveyor web about the upper side members to move the patient from the first support to the upper conveyor web.

27. The apparatus of claim 26, wherein the drive web and the conveyor web are configured to be operatively disconnected such that movement of the drive web about the lower side members to move the apparatus from the first support to the second support moves the patient on the conveyor web from the first support to the second support.

28. The apparatus of claim 27, wherein the drive web and the conveyor web are configured to be operatively connected such that movement of the drive web about the lower side members to move the apparatus out from under the patient moves the patient from the conveyor web to the second support.

29. A patient transfer apparatus comprising:

an upper conveyor, a lower conveyor, each conveyor comprising laterally spaced-apart, longitudinally extending side members and a web trained about the side members for movement, an adjustment mechanism for raising and lowering the upper conveyor relative to the lower conveyor, the adjustment mechanism including a lift handle movable to a first position to raise the upper conveyor relative to the lower conveyor and movable to a second position to lower the upper conveyor relative to the lower conveyor, the upper conveyor web engaging the lower conveyor web to couple the motion of the lower conveyor web to the upper conveyor web when the upper conveyor is lowered, the upper conveyor web disengaging from the lower conveyor web for transport of a patient positioned on the upper conveyor web when the upper conveyor is raised, the adjustment mechanism being configured to raise and lower the upper conveyor relative to the lower conveyor while the upper and lower conveyors are stationary, the conveyors being configured to be operatively connected to couple movement of the lower conveyor web to the upper conveyor web such that, when the lower conveyor web is driven to move under the patient, the upper conveyor web is driven to move the patient onto the upper conveyor web, the conveyors being configured to be operatively disconnected such that movement of the lower conveyor web about the side members of the lower conveyor moves the patient positioned on the upper conveyor web from one support to another support without moving the upper conveyor web about the side members of the upper conveyor.

* * * * *